US010697600B2

(12) United States Patent
Doll

(10) Patent No.: US 10,697,600 B2
(45) Date of Patent: Jun. 30, 2020

(54) ECONOMICAL CONSTRUCTION OF LED LIGHTING FIXTURES

(71) Applicant: Contemporary Communications, Inc., Saratoga, CA (US)

(72) Inventor: Joseph Doll, Saratoga, CA (US)

( * ) Notice: Subject to any disclaimer, the term of this patent is extended or adjusted under 35 U.S.C. 154(b) by 0 days.

(21) Appl. No.: 16/211,514

(22) Filed: Dec. 6, 2018

(65) Prior Publication Data

US 2019/0234568 A1 Aug. 1, 2019

Related U.S. Application Data

(60) Provisional application No. 62/624,716, filed on Jan. 31, 2018.

(51) Int. Cl.

| | |
|---|---|
| ***F21V 7/00*** | (2006.01) |
| ***F21S 8/04*** | (2006.01) |
| ***F21V 3/02*** | (2006.01) |
| ***F21V 7/04*** | (2006.01) |
| ***F21K 9/20*** | (2016.01) |
| ***F21V 5/04*** | (2006.01) |
| ***F21V 21/03*** | (2006.01) |
| ***F21V 17/10*** | (2006.01) |
| ***F21S 6/00*** | (2006.01) |
| ***F21S 4/24*** | (2016.01) |
| *F21Y 107/30* | (2016.01) |
| *F21Y 115/10* | (2016.01) |
| *F21Y 107/00* | (2016.01) |

(52) U.S. Cl.

CPC *F21S 8/04* (2013.01); *F21K 9/20* (2016.08); *F21S 4/24* (2016.01); *F21S 6/002* (2013.01); *F21V 3/02* (2013.01); *F21V 5/04* (2013.01); *F21V 7/041* (2013.01); *F21V 17/101* (2013.01); *F21V 21/03* (2013.01); *F21Y 2107/00* (2016.08); *F21Y 2107/30* (2016.08); *F21Y 2115/10* (2016.08)

(58) Field of Classification Search

None

See application file for complete search history.

(56) References Cited

U.S. PATENT DOCUMENTS

2017/0082251 A1* 3/2017 Tannahill ..... F21S 4/22

FOREIGN PATENT DOCUMENTS

CN 203999786 U * 12/2014
DE 202014005059 U1 * 9/2014 ..... F21S 4/28

* cited by examiner

*Primary Examiner* — Vip Patel
(74) *Attorney, Agent, or Firm* — Joseph L. Acayan

(57) ABSTRACT

Implementations generally relate to facilitating use of high volume, highly standardized low cost components, with a minimum of specialty components, in the manufacture of light emitting diode (LED) light fixtures. In some embodiments, an apparatus for providing LED lighting includes a physical form having a predetermined shape, where the form is configured to support at least one LED strip thereto, and where the predetermined shape causes the at least one LED strip to be so configured as to emit light in a predetermined emission pattern when the at least one LED strip is coupled to the physical form. The apparatus further includes at least one constraint mechanism, where the at least one constraint mechanism, in whole or in part, constrains the at least one LED strip to remain configured to its predetermined shape.

20 Claims, 18 Drawing Sheets

700

700

1200

1200

1500

1800

ECONOMICAL CONSTRUCTION OF LED LIGHTING FIXTURES

CROSS REFERENCE TO RELATED APPLICATIONS

This application claims priority from U.S. Provisional Patent Application No. 62/624,716, entitled "Economical Construction of LED Lighting Fixtures," filed Jan. 31, 2018, which is hereby incorporated by reference as if set forth in full in this application for all purposes.

BACKGROUND

Light emitting diode (LED) lighting systems have gained in popularity, as LEDs are more efficient than incandescent alternatives. LEDs also support an adjustable color mix and support a rich array of control choices, such as color temperature adjustment, hue selection, and animated sequencing not available with traditional incandescent or fluorescent lighting systems. LED systems do present challenges and complexities. For example, traditional light fixture manufacturing techniques rely on standard electrical sockets, into which standard light bulbs may be installed. While LEDs may be incorporated within standard sized bulbs, that configuration carries a cost burden due to relative complexity, while the long life of LEDs obviates need to make lights replaceable. Luminous efficiency of LEDs continues to improve, reducing heat that requires thermal management in fixtures. Many manufacturers incorporate custom "chip on board" solutions, in which LEDs and associated driving circuitry are mounted on custom circuit boards designed to complement particular fixtures. That approach improves manufacturability and costs, yet falls short of leveraging high volume, high standardization components for optimum cost benefit, and minimum design cycle time and cost.

SUMMARY

Implementations generally relate to facilitating use of high volume, highly standardized low cost components, and minimizing cost and number of specialty components, in the manufacture of LED light fixtures. In some embodiments, an apparatus for providing LED lighting includes a physical form having a predetermined shape, where the form is configured to support at least one LED strip thereto, and where the predetermined shape causes the at least one LED strip to be so configured as to emit light in a predetermined emission pattern when the at least one LED strip is coupled to the physical form. The apparatus further includes at least one constraint mechanism, where the at least one constraint mechanism, in whole or in part, constrains the at least one LED strip to remain configured to its predetermined shape.

Other aspects and advantages of the described implementations will become apparent from the following detailed description, taken in conjunction with the accompanying drawings, illustrating by way of example the principles of the described implementations.

DETAILED DESCRIPTION

Implementations described herein enable use of high volume, standardized and economical LED strips, LED power supplies, and LED controllers as the illumination components of efficient, attractive and economical LED lighting fixtures. As described in more detail below, in various implementations, one or more LED strip configuration forms physically configure one or more LED strip segments into an attractive and efficacious source of illumination, while, in various implementations, complementary forms position and retain necessary power supplies and control circuits. In some implementations, one or more complementary lens or diffuser components, typically in conjunction with standard fastener components, complete an entire fixture.

In general, LED strip configuration forms, complementary component positioning forms, and lens or diffuser components are amenable to manufacturing techniques that are low in cost even at low volumes. Thus, a wide variety of aesthetic designs may be achieved economically, with only limited volume requirements for each.

In particular, flexible LED strips, and pre-packaged electronic systems to drive them, have evolved into high volume, low cost commodities. While LED strips are popularly employed in linear fluorescent replacement tubes, their physical configuration is unsuitable for many fixtures. LED based direct replacements for fluorescent tubes, when designed to be directly driven by the circuitry of their predecessors, carry a cost burden in their custom electronics. Implementations described herein adapt LED strips and standardized driving components for easy and economical incorporation into a variety of attractive ceiling, wall, and lamp fixtures. In particular, "LED strip configuration forms" are described as having properties capable of physically configuring LED strips into geometries suitable for use within lighting fixtures, including standardized off-the-shelf fixtures. Similarly, "component placement forms," or alternatively "component positioning forms," are described as having properties capable of physically positioning ancillary components, such as power supplies and LED controllers, within lighting fixtures.

Figure 1:
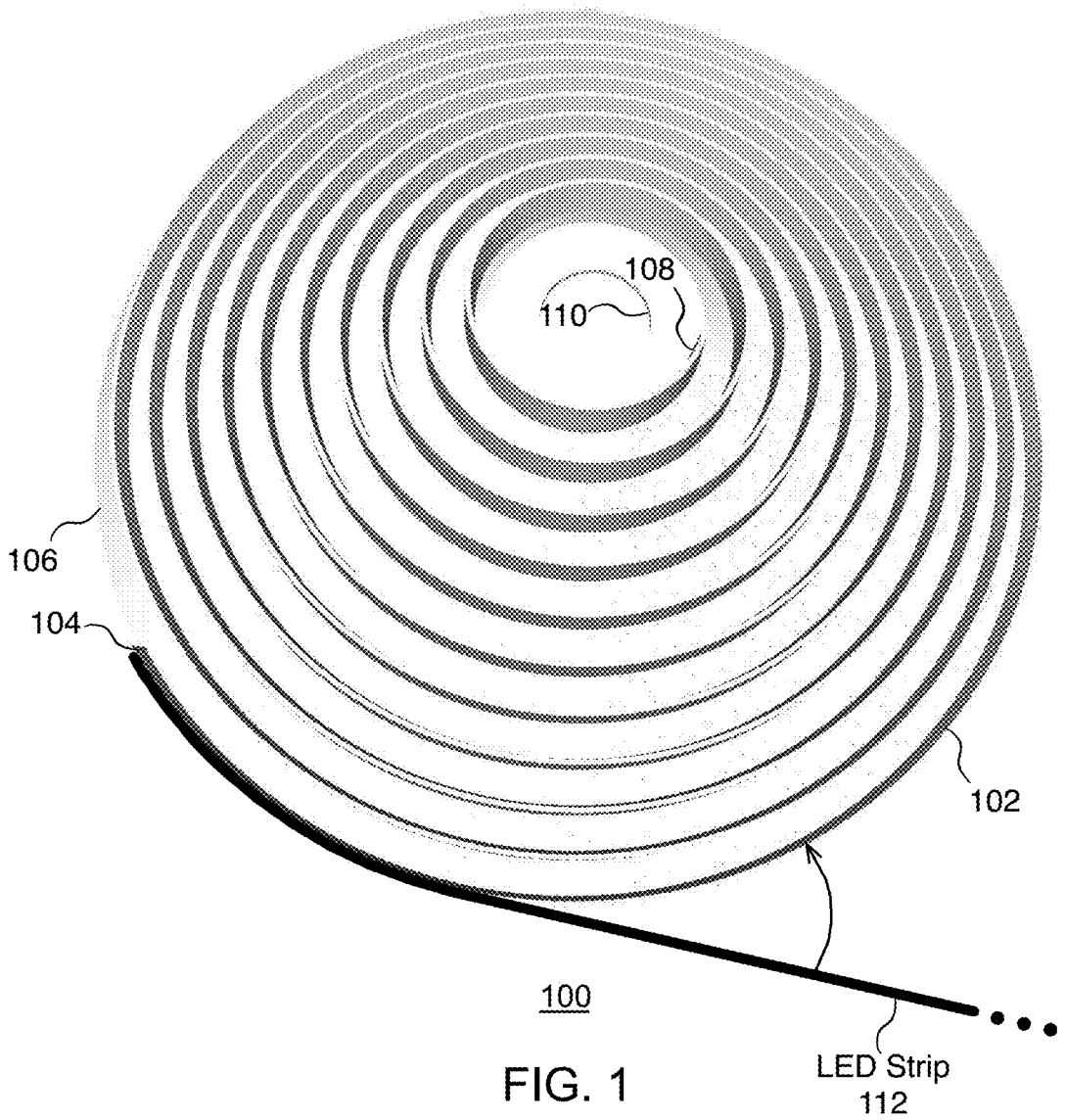
FIG. 1 illustrates a perspective view of an example LED strip configuration form in a ceiling fixture configuration, according to some implementations.

FIG. 1 illustrates a perspective view of an example LED strip configuration form 100 in a ceiling fixture configuration, according to some implementations. The overall form 100 is a physical form that is single, contiguous piece of material with a predetermined shape. Its geometry may be recognized as including three distinct portions, where each part contributes unique aspects to the overall functionality of the form.

Active guide portion 102 includes material supporting a surface operational to both guide and constrain the intended path of LED strip 112. LED strip 112 is shown for illustrative purposes, and is not part of the form. Active guide portion 102 is configured in this example as an ascending spiral, having one end 104 at the outer edge 106 of LED strip configuration form 100 and another end 108 near the center opening 110. As such, active guide portion 102 functions as a track with a geometry to which an LED strip can comply and may be affixed thereto. In various implementations, LED strip configuration form 100 is configured to support an LED strip 112. As shown, LED strip 112 attaches or couples to LED strip configuration form 100 by wrapping around active guide portion 102. Center opening 110 is a feature of the fixture infrastructure portion of LED strip configuration form 100. In this example, the fixture infrastructure portion consists of a planar disc positioned coaxially with center opening 110, with diameter meeting the innermost part of the scaffolding portion that supports end 108 of active guide portion 102. In this example, the fixture infrastructure portion facilitates mounting LED strip configuration from 110 to the threaded center stem of a fixture using one or more threaded nuts, optionally supplemented by one or more washers. Outer edge 106 of LED configuration form 100 is another feature of the infrastructure portion of the form. It extends from the outer edge to the point at which it meets the outermost part of the scaffolding portion that supports active guide portion 102. The outer edge fixture infrastructure feature assures stable positioning of LED strip configuration form 100 when pressed against external fixture infrastructure as a result of pressure applied by use of abovementioned threaded nut(s) and associated washer(s) near center opening 110.

The LED strip configuration form of FIG. 1 may be directly produced by a three-dimensional (3D) printer. When printed in a suitable material, such a form may be used directly in a thermoform molding process. In some implementations, LED strip configuration form 100 is configured such that a reflective material may be coupled to the LED strip configuration form 100, where the reflective material conforms to the shape of form 100 and alters the predetermined light emission pattern. For example, the shape of LED strip configuration form 100 may achieve a reasonably uniform and pleasing emission pattern. In some implementations, a white material may be used to promote reflectivity. Contours may be curved in particular directions (e.g., downward or laterally in order to promote reflection versus entrapment of light. To further improve light output, the molded part may be of high reflectivity material, or of clear material backed by a reflective layer such as aluminum foil.

Figure 2:
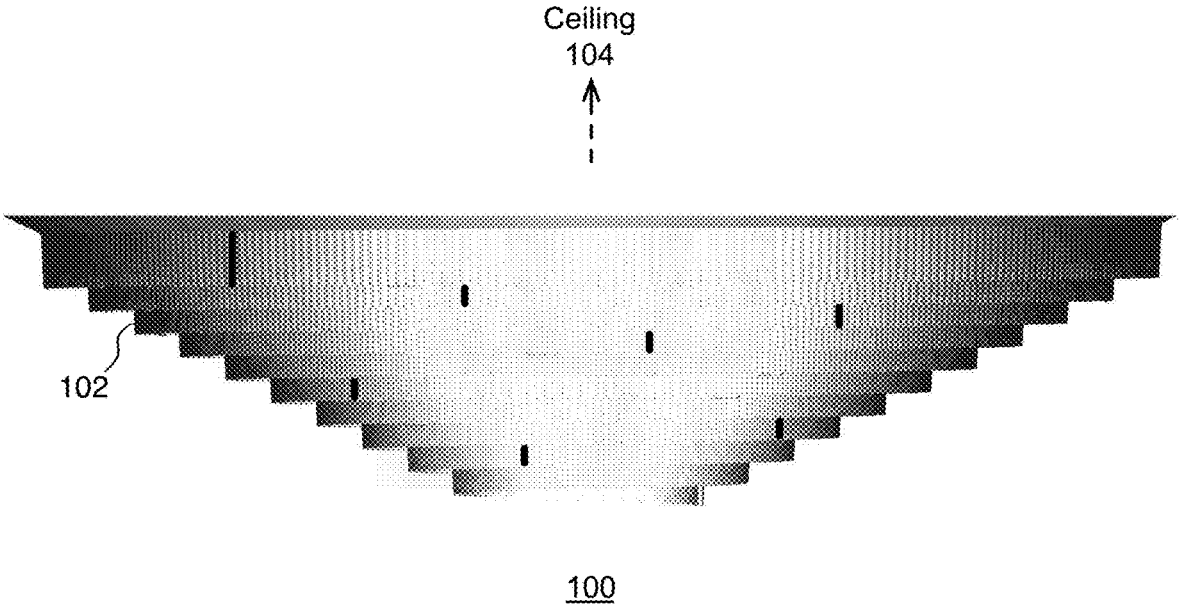
FIG. 2 illustrates a side view of the example LED strip configuration form of FIG. 1, according to some implementations.

FIG. 2 illustrates a side view of the example LED strip configuration form 100 of FIG. 1, according to some implementations. The spirally configured active guide portion 102 is highlighted as a primary focus. In this particular view, LED strip configuration form 100 is oriented such that the wider end faces upward toward the ceiling 104 and the narrower end faces downward away from the ceiling 104.

The active guide portion 102 of LED strip configuration form 100 serves to configure a 5-meter LED strip into a conical spiral that fits within the original fixture globe. In some implementations, marking features may be incorporated within the form. A predetermined number of length markers (e.g., ten dark markings) at various positions along the LED strip active guide portion highlight areas that are slightly raised. These areas have been highlighted with dark vertical lines for improved visibility. These length markers divide the overall length of the active guide portion 102 into smaller segments (e.g., divide a full five-meter length into half-meter segments). Such length markers may be any color and may be drawn at any predetermined lengths with any suitable pigmenting system, or may be incorporated as small variations in surface position or texture. In some implementations, length markers may facilitate removal of an innermost and/or outermost portion of the form, thus adapting it for a shorter segment of LED strip. In some implementations, length markers function to facilitate cutting LED strip forms to smaller sizes. Length markers are more feasible for thermoformed parts than thick, printed parts.

The luminous body geometry of this example is a conical shape. It may be observed the vertical displacement per turn is less than the full height of the spiral track. This characteristic may be thought of as vertical compression, or a reduction in the slope of the cone. This compression aspect permits use of longer LED strips, and thus brighter illumination than would be possible if the vertical displacement of each turn were required to be at least the full width of the LED strip.

Figure 3:
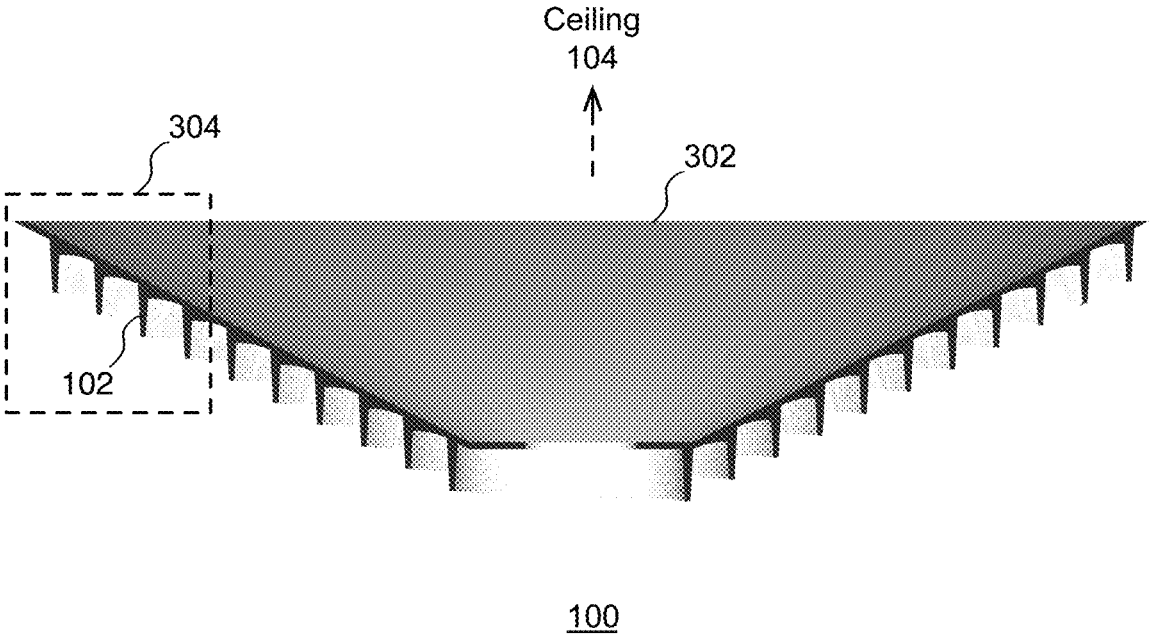
FIG. 3 illustrates a cross-sectional view of the example LED strip configuration form of FIG. 1, according to some implementations.

FIG. 3 illustrates a cross-sectional view of the example LED strip configuration form 100 of FIG. 1, according to some implementations. Active guide portion 102 and a scaffolding portion 302 are highlighted for focus. In various implementations, active guide portion 102 and scaffolding portion 302 are part of and made from a single piece of material (e.g., molded plastic, printed plastic, etc.), where active guide portion 102 extends away from scaffolding portion 302. Example implementations directed to the formation of LED strip configuration form 100 are described in more detail herein. A portion 304 of LED strip configuration form 100 is described in more detail in connection with FIG. 4.

Scaffolding portion 302 serves to support active guide portion 102, thereby stabilizing its geometry and establishing the overall shape of the fixture's luminous geometry, depicted in this example as a conical shape In various implementations, LED strip configuration form 100 has a predetermined luminous body shape. In this particular implementation, the predetermined luminous body shape is conical. In various implementations, active guide portion 102 is configured to support one or more LED strips thereto, such as LED strip 112 of FIG. 1. For example, active guide portion 102 supports an LED strip by providing a spirally configured surface upon which an LED strip is wrapped.

As described in more detail herein, a predetermined shape causes the LED strip to be so configured as to emit light in a predetermined emission pattern when the LED strip is coupled to form active guide portion 102 of LED strip configuration form 100. For example, scaffolding portion 302 imparts a conical shape as shown. As such, when an LED strip is wrapped around spirally configured active guide portion 102, the LED strip 112 forms a conical shape that conforms to the conical shape of scaffolding portion 302. In this particular example, the LED strip emits light from a luminous body geometry that is conical in shape. In various implementations, a downward/outward emission pattern is fostered by the configuration and reflectance of active guide portion 102 and scaffolding portion 302.

In various implementations, LED strip configuration form 100 also includes at least one constraint mechanism. In this example, spirally configured active guide portion 102 is a constraint mechanism. The constraint mechanism, in whole or in part, constrains the LED strip to remain configured to its predetermined shape. In this example, the predetermined shape of the LED strip configuration form 100 is a compound geometry including active guide, scaffolding, and fixture infrastructure portions. The luminous body shape thus produced is conical.

Figure 4:
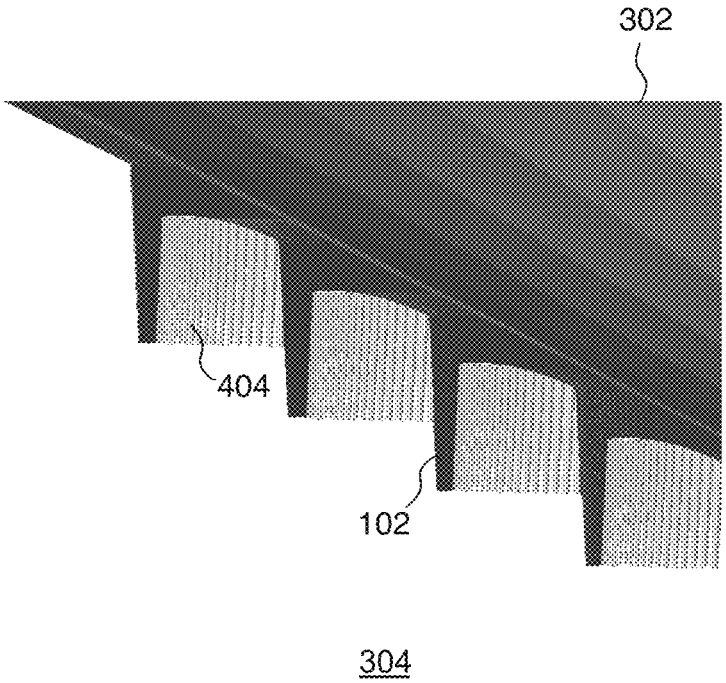
FIG. 4 illustrates a cross-sectional view of a portion of the LED strip configuration form of FIG. 3, according to some implementations.

FIG. 4 illustrates a cross-sectional view of portion 304 of LED strip configuration form 100 of FIG. 3, according to some implementations. As shown, scaffolding portion 302 provides the overall luminous body shape of LED strip configuration form 100, and scaffolding portion 302 shapes and supports spirally configured active guide portion 102. As shown, active guide portion 102 is the outer surface of a wall, the an inner surface of which, 404 may be considered scaffolding. As such, active guide portion 102 functions as a constraint mechanism to which an LED strip may be attached, where the LED strip attaches to the outer surface 102, similar to the LED strip wrapping around active guide portion 102 as shown in FIG. 1.

This design applies curvature with respect to the 60-degree rise of the conical shape of its luminous body geometry. Upon review, curvature with respect to a horizontal surface would improve reflective performance. To achieve vertical reflection, the curved surface should be horizontal directly above the LED emitter, and sloping downward at a 45-degree angle directly in front of the LED emitter.

In some implementations, LED strip configuration form 100 includes removable portions that when removed alter a size of form 100 for target fixtures. Thermoform molded LED strip configuration forms may be reproduced inexpensively. They do not need great strength for use in an enclosed fixture, so may be formed from relatively thin material. Such construction may adapt a single form size to different size fixtures by cutting the forms, such that, for example, only the inner 4 meters, or the outer 4 meters, remain. Length markers molded into the forms facilitate such cutting.

The material used for LED strip configuration form 100 may be a variety of material types. For example, in some implementations, form 100 may be made of a predetermined type of plastic. In some implementations, the form 100 may be made of a predetermined type of metal. The geometry of the LED strip configuration form of FIG. 1 is also compatible with production by a sheet metal stamping process. Though more expensive, robustly rigid sheet metal may be desirable in mobile or high vibration environments. It may also be desirable in applications that employ high intensity, high power LEDs or other heat producing components that require superior heat conduction for thermal management. Sheet metal may also be desirable for high temperature operation, which may exceed the glass transition temperature of thermoformed plastic.

In various implementations, the LED strip configuration form includes geometrical features that facilitate positioning and constraint of components in addition to the at least one LED strip that contribute to overall function of a complete lighting fixture.

The geometrical details or portions of the LED strip configuration form that interacts directly with the LED strip and its emitted light field constitute strip scale geometry. As such, the strip scale geometry is based on the dimensions of the LED strip segment(s) with which the LED strip configuration form is intended to be mated.

Figure 5:
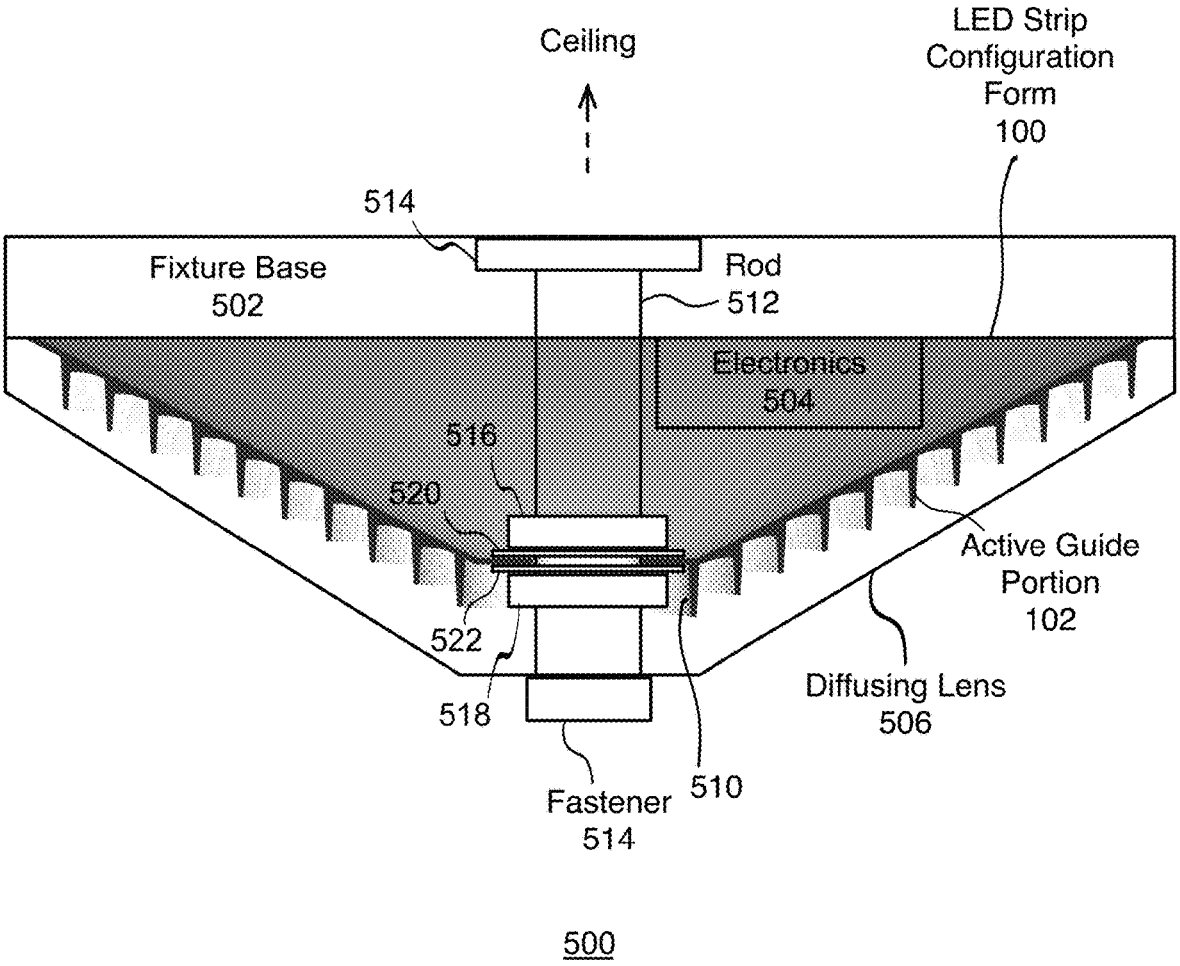
FIG. 5 illustrates an example fixture assembly that includes the example LED strip configuration form of FIG. 1, according to some implementations.

The predetermined shape of form 100 depicted in FIG. 5 has a luminous body geometry that is conical in shape. The overall conical shape of the LED strip assembly constitutes its overall luminous body geometry. In other words, the luminous body geometry is based on the overall shape of the LED strip assembly, where the overall shape of the LED strip assembly is based, in part, on strip scale geometry. For example, if the strip scale geometry is configured to conform to an overall shape that is conical, the overall luminous body geometry of the LED strip assembly is also conical. In some implementations, in addition to the luminous body geometry, the LED strip configuration form may have additional features to facilitate mounting of the strip assembly to a fixture, or mounting of an accessory such as a power supply. In various implementations, the LED strip assembly is a combination of an LED Strip with an LED strip configuration form and associated constraint mechanisms.

FIG. 5 illustrates an example fixture assembly 500 that includes the example LED strip configuration form 100 of FIG. 1, according to some implementations. Shown is LED strip configuration form 100, which is attached to a fixture base 502. In this particular implementation, fixture base 502, an element of a fixture infrastructure, is configured to mount to a ceiling. In various implementations, fixture base 502 has a predetermined shape. In this particular implementation, fixture base 502 has a cylindrical shape. The particular size relative to the LED strip configuration form 100 may vary and will depend on the particular implementation. In various implementations, fixture base 502 is configured to support one or more fixture components thereto. For example, fixture base 502 may be configured such that electronics 504, LED strip configuration form 100, and a diffusing lens 506 are attached to fixture base 502. In various implementations, electronics 504 may include any necessary electronic components (not shown) including electronic circuitry, a power supply, etc.

Various implementations also function to position ancillary components. For example, in some implementations, LED strip configuration form 100 has a physical form that has a predetermined shape such that the form is configured to support at least one fixture component thereto. The predetermined shape causes a fixture component to be so positioned as to contribute to overall function of a complete lighting fixture when the at least one fixture component is coupled to other components of the fixture component. In various implementations, the constraint mechanism, in whole or in part, constrains the fixture component to remain so positioned. As shown, the fixture assembly 500 also includes a constraint mechanism. In this example, the constraint mechanism is spirally configured active guide portion 102. The constraint mechanism, in whole or in part, constrains the at least one fixture component (e.g., an LED strip) to remain so positioned.

Shown is a profile of the innermost spiral ring 510, followed by similar profiles progressing upward at a 60-degree angle from horizontal, and outward at 10 mm horizontal spacing. The particular angle and spacing may vary, depending on the particular implementation. The outward face of the spiral is the intended active guide track for an LED strip.

Rod 512 is an element of a fixture infrastructure, which, in conjunction with other fastener elements, holds fixture base 502, LED strip configuration form 100, and diffusing lens 506 together. In some implementations, the fixture infrastructure includes a threaded rod 512 coupled to nuts 514, 516, and 518, washers 520 and 522, and a fastener 514. These elements of fixture infrastructure may also be referred to as fixture infrastructure components. In other implementations, the fixture infrastructure may not have all of the components shown and/or may have other elements including other types of elements instead of, or in addition to, those shown herein.

In various implementations, the upper portion of rod 512 may connect to hardware in the ceiling and be secured to it with nut 514 (optionally with a lock washer) shown at the top portion of rod 512. The middle portion of rod 512 passes through fixture base 502 and LED strip configuration form 100. As indicated above, LED strip configuration form 100 is secured by nuts 516 and 518, and washers 520 and 522 above and below its position along rod 512. The lowest portion of rod 512 screws into a nut or fastener 514, which serves to secure the position of diffusing lens 506. Torque on the outermost nut or fastener 514 presses the outer rim of diffusing lens 506 against the wall or ceiling or fixture base, thus mechanically stabilizing the outermost portions of the fixture assembly.

Figure 6:
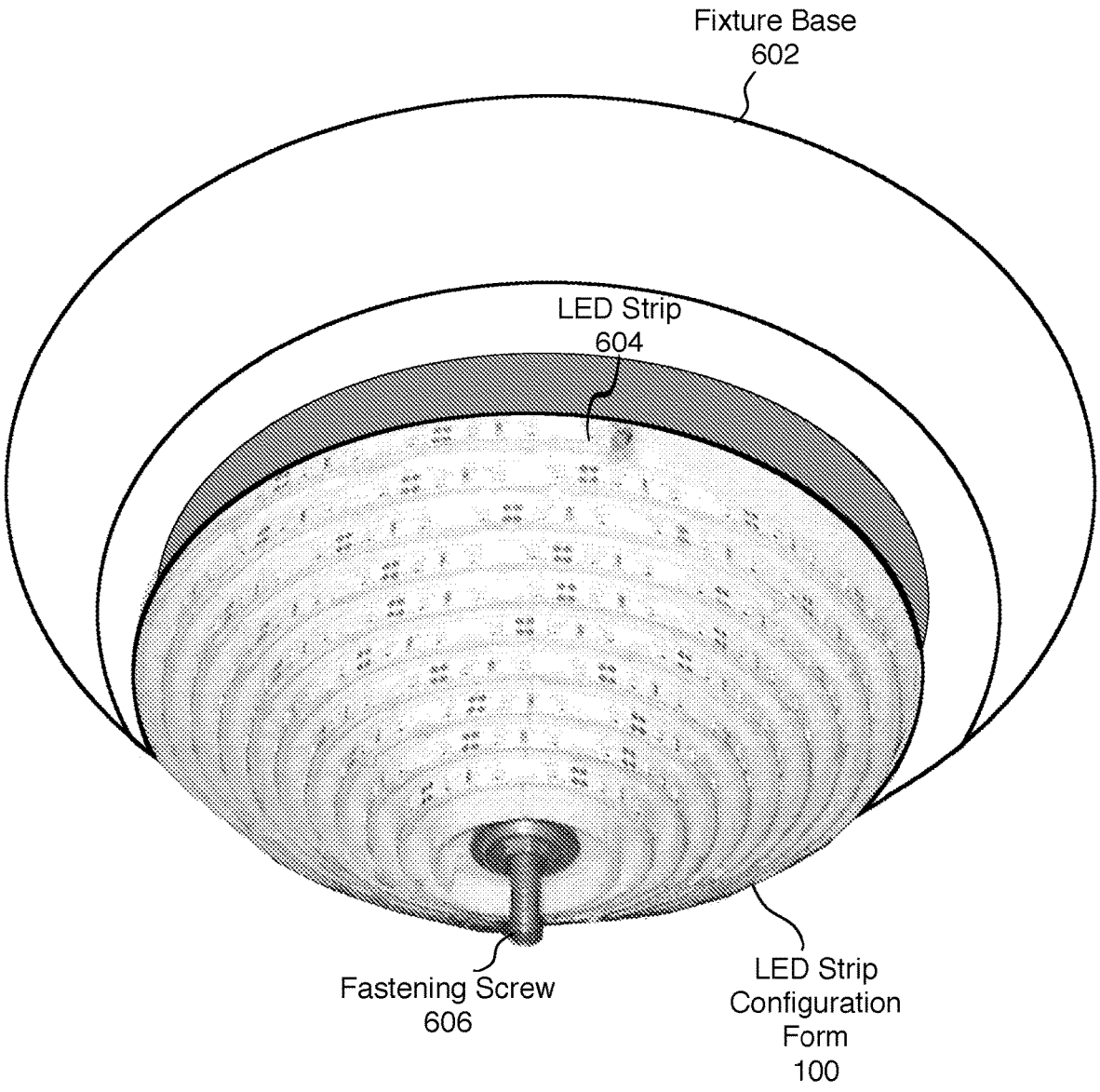
FIG. 6 illustrates a perspective view of the example LED strip configuration form of FIG. 1 mounted to a fixture base, according to some implementations.

FIG. 6 illustrates a perspective view of the example LED strip configuration form 100 of FIG. 1 mounted to a fixture base 602, according to some implementations. Fixture base 602 is part of a ceiling fixture that is largely hidden from view. The ceiling fixture is a legacy 3-bulb ceiling fixture converted to LED illumination by use of an LED strip configuration form.

The example legacy fixture of FIG. 6 is rated for three 75-watt incandescent bulbs, producing about 3300 lumens while consuming 225 watts. Compact fluorescent "100-watt equivalent" bulbs raised light output to 4800 lumens while consuming 69 watts. The 12-volt, 5-meter LED strip of the final configuration raised light output to 5580 lumens, driven by a 60-watt power supply. It produces superior color rendering index (CRI) greater than 90 light quality. The LED configuration also incorporates a dimming controller not available for compact fluorescents. The particular electronic specifications may vary, depending on the particular implementation.

Also shown is an LED strip 604 that is wrapped around LED strip configuration form 100. In some implementations, LED strip configuration form 100 is attached to fixture base 602 with a central fastening mechanism such as a fastening screw 606.

In some implementations, fixture base 602, and one or more related fixture infrastructure components, may secure in place a component positioning form (hidden from view), which holds a dimming controller module and LED power supply (hidden from view) in place within the fixture. The necessary power supply and the component positioning form may both be mounted within the fixture by means of a simple flat washer and nut affixed to the central threaded stem rod of the fixture. The nut is tightened to raise the form until it presses against the structures above. Following this step, the original lens is affixed to the center stem with its decorative washer and finial nut to complete the retrofit.

In operation, light from LEDs within the outer-most spiral will radiate unimpeded. Some light from LEDs from inner spirals will pass unimpeded, some will strike the backing surface of the next outward-most spiral, and some will strike the upper surface. Careful design can optimize lighting efficiency by using high reflectivity material, and contouring surfaces for minimum reflections before exit. In addition, surface contours may be designed to reflect light in conformance with a variety of emission patterns as may be deemed desirable. For example, if a very directional emission pattern (e.g., a spot light) is desired, the spiral track may be given a large vertical dimension, and the LED strip mounted as far as possible into the semi-enclosed space thus formed. Light would be thereby be channeled into a primarily vertical exit path. In some implementations, the outer-most spiral may be used as a reflector, not as a mounting surface for outward facing LEDs. In addition, radiation characteristics of specific LEDs intended to be used may be taken into account.

For efficient manufacture, it is proposed that LED strip configuration forms with functional geometries similar to those of FIG. 1 through FIG. 16 be created with a molding process such as thermoforming. Forms so produced will likely be made of thin sheet material, heated to a pliable temperature and conformed to the active surface of a mold with vacuum. With minor adjustments, the 3D printed form of this example may be used as a mold for such a process. The product would not have the relatively smooth conical inner surface as that of the example. Instead, its inner surface would mirror its outer surface with a depression opposite every prominence and vice versa. When 3D printed for use as a molding form, the inner portion of the cone may be completely filled for added strength.

For optimal LED strip conformance to the LED strip configuration form, a vertical mounting surface would be ideal. The design of FIG. 1 deviates from that ideal by a 3-degree draft angle to facilitate removal of thermoformed copies after molding.

The retrofit performed on the fixture of FIG. 1 does not damage the original fixture in any way. Thus, the retrofit is completely reversible. Should the LED strip need to be changed in the future, replacing the LED strip, or returning the fixture to its original configuration employing discrete bulbs, is very easy.

Figure 7:
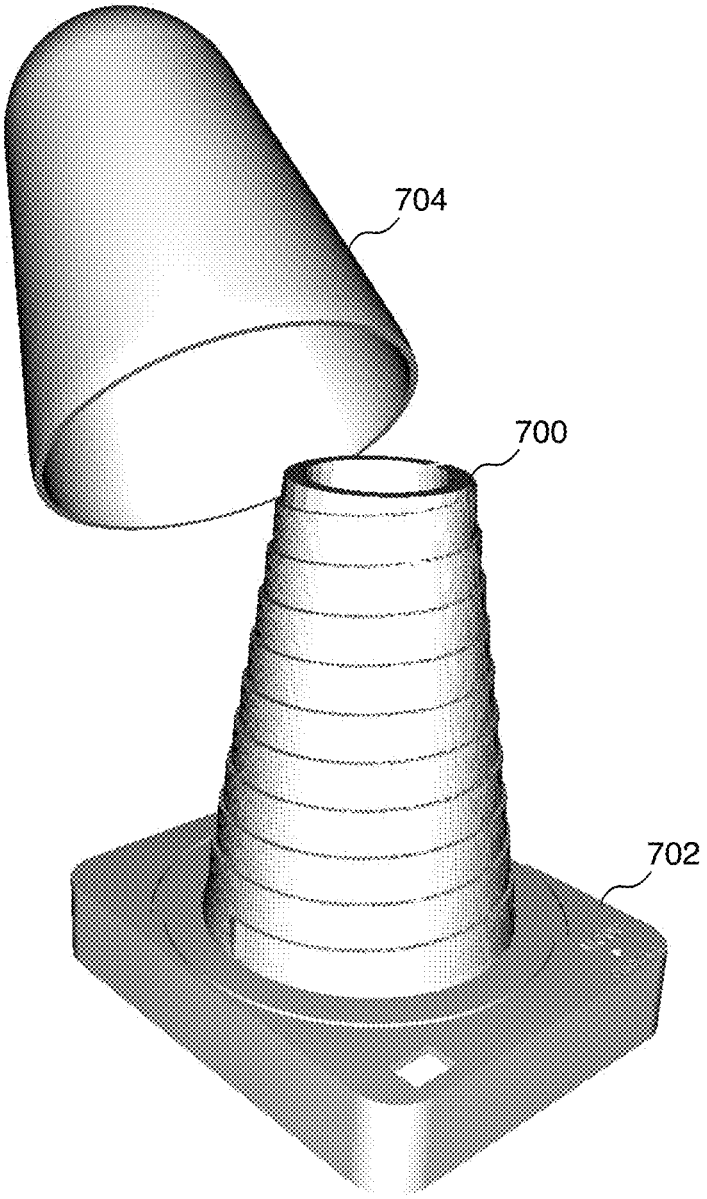
FIG. 7 illustrates a perspective view of an example LED strip configuration form in a table lamp configuration, according to some implementations.

FIG. 7 illustrates a perspective view of an example LED strip configuration form 700 in a table lamp configuration, according to some implementations. In this example implementation, LED strip configuration form 700 is mounted onto a fixture base 702, which may rest on a horizontal surface such as a table top, counter top, shelf, etc. Also shown is a diffusing lens 704.

Figure 8:
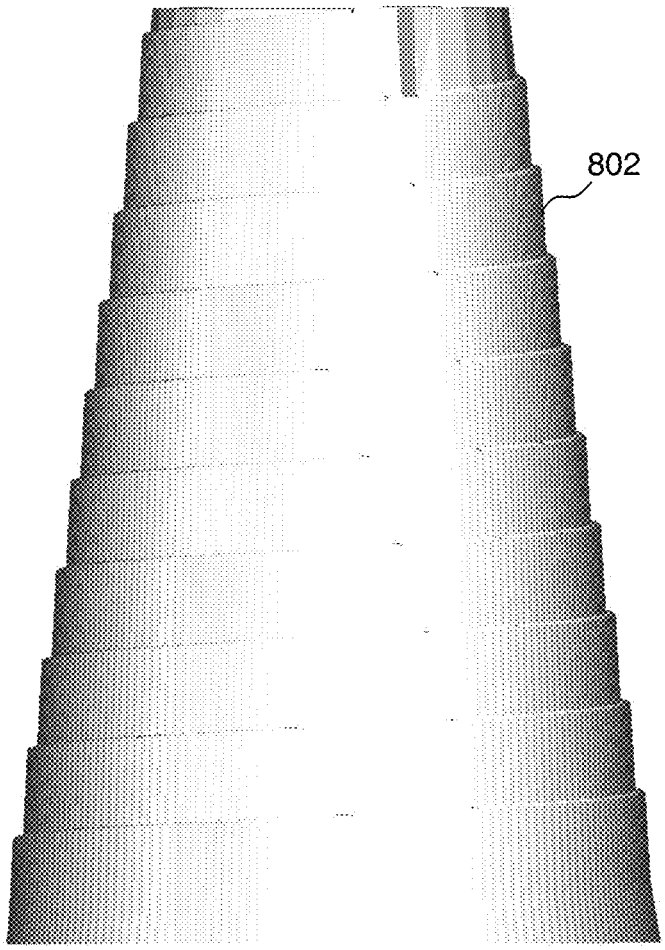
FIG. 8 illustrates a side view of the example LED strip configuration form of FIG. 7, according to some implementations.

FIG. 8 illustrates a side view of the example LED strip configuration 700 form of FIG. 7, according to some implementations. As shown, LED strip configuration form 700 is conical in overall shape and includes a spirally configured active guide portion 802. Active guide portion 802 is configured such that it spirals around LED strip configuration form 100. Active guide portion 802 functions as a track that guides an LED strip as the LED strip is attached to active guide portion 802. In various implementations, LED strip configuration form 700 is configured to support an LED strip (not shown) that attaches with adhesive or couples to LED strip configuration form 100 by wrapping around spiral portion 802.

Figure 9:
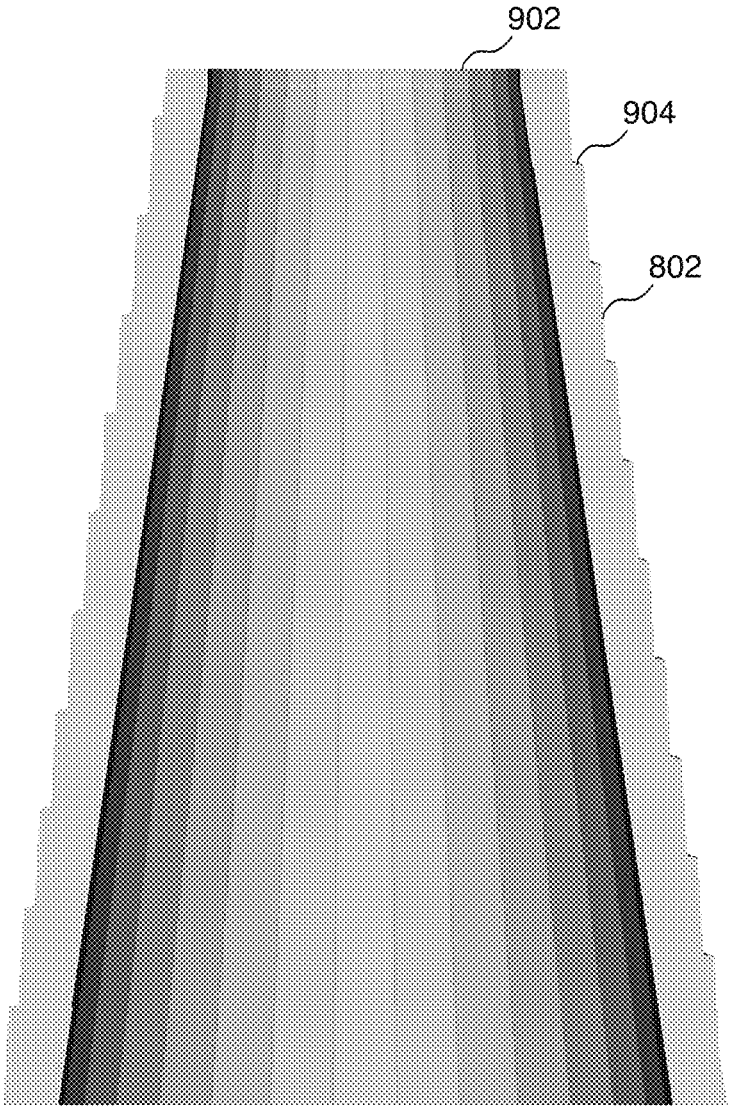
FIG. 9 illustrates a cross-sectional view of the example LED strip configuration form of FIG. 7, according to some implementations.

FIG. 9 illustrates a cross-sectional view of the example LED strip configuration form 700 of FIG. 7, according to some implementations. Shown are spirally configured active guide portion 802 and a scaffolding portion 902. As shown, in various implementations, active guide portion 802 and scaffolding portion 902 are part of and made from a single piece of material, where active guide portion 802 forms steps 904 as the track of spirally configured active guide portion 802 wraps around LED strip configuration form 700.

As shown, the overall luminous body geometry of LED strip configuration form 700 is a truncated cone. Its strip scale geometry is vertically uncompressed, and the vertical displacement of a single spiral turn is greater than the width of the spiraling LED strip-mounting surface.

The cross section shown differs slightly from the physical LED strip configuration form in that the top has a round cap instead of an access opening, and cable access slits are not included. These changes make the form suitable for direct use as a mold for use in a thermoforming process. Multiple inexpensive working copies of the LED strip configuration form could be produced from such a mold. Outer surfaces of the spiral track feature a small draft angle to facilitate removal of the molded copies, even though a strictly vertical orientation would more ideally conform to a flexible LED strip.

Figure 10:
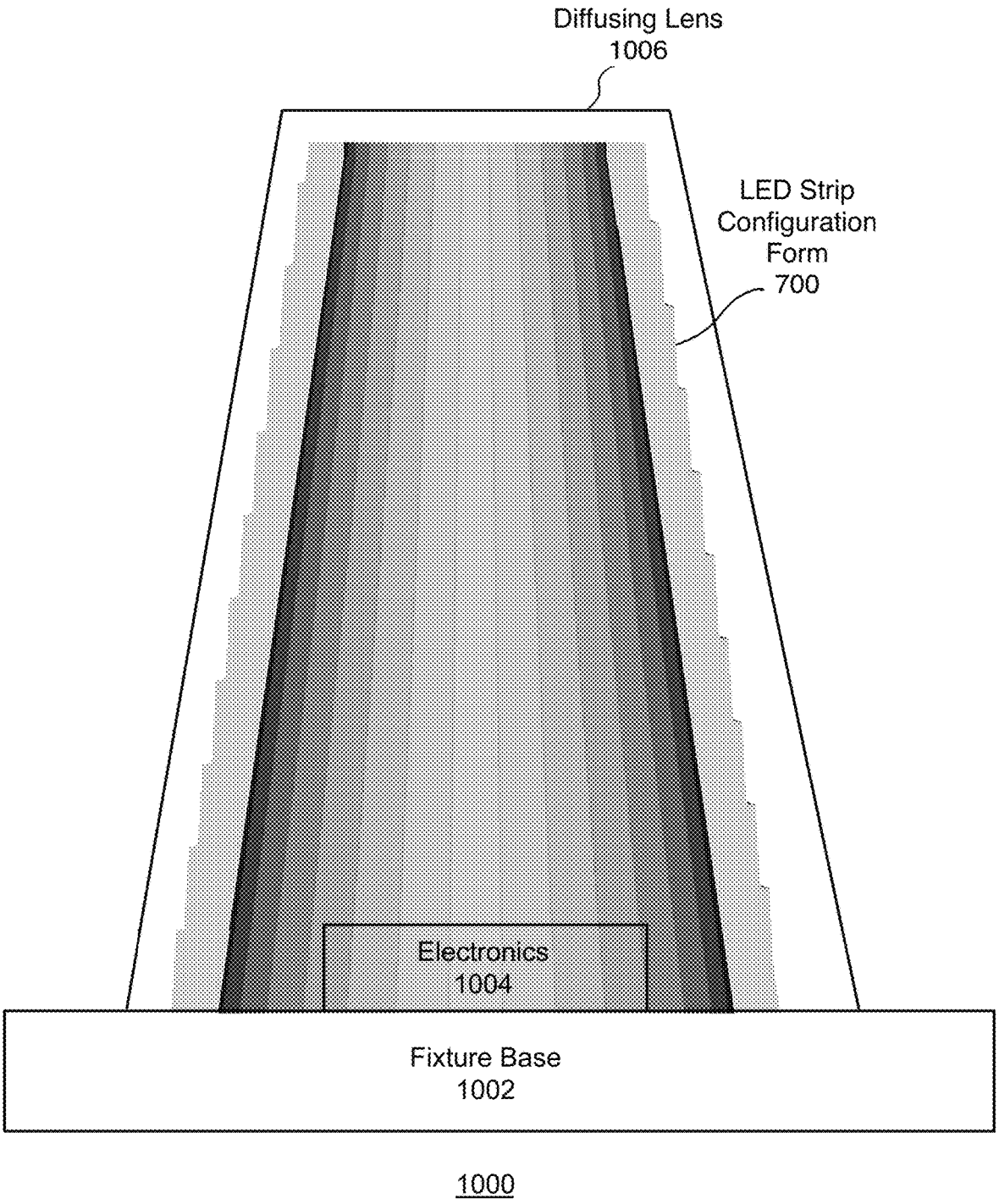
FIG. 10 illustrates an example fixture assembly that includes the example LED strip configuration form of FIG. 7, according to some implementations.

FIG. 10 illustrates an example fixture assembly 1000 that includes the example LED strip configuration form 700 of FIG. 7, according to some implementations. Shown is LED strip configuration form 700, which is attached to a fixture base 1002. As indicated above, fixture base 1002 is configured to rest on a horizontal surface such as a table. In various implementations, fixture base 1002 has a predetermined shape. In this particular implementation, the fixture base has a rectangular shape. The particular size relative to the LED strip configuration form may vary and will depend on the particular implementation. In various implementations, fixture base 1002 is configured to support one or more fixture components such as electronics 1004, LED strip configuration form 700, and a diffusing lens 1006. In various implementations, electronics 1004 may include any necessary electronic components (not shown) including electronic circuitry, a power supply, etc.

Figure 11:
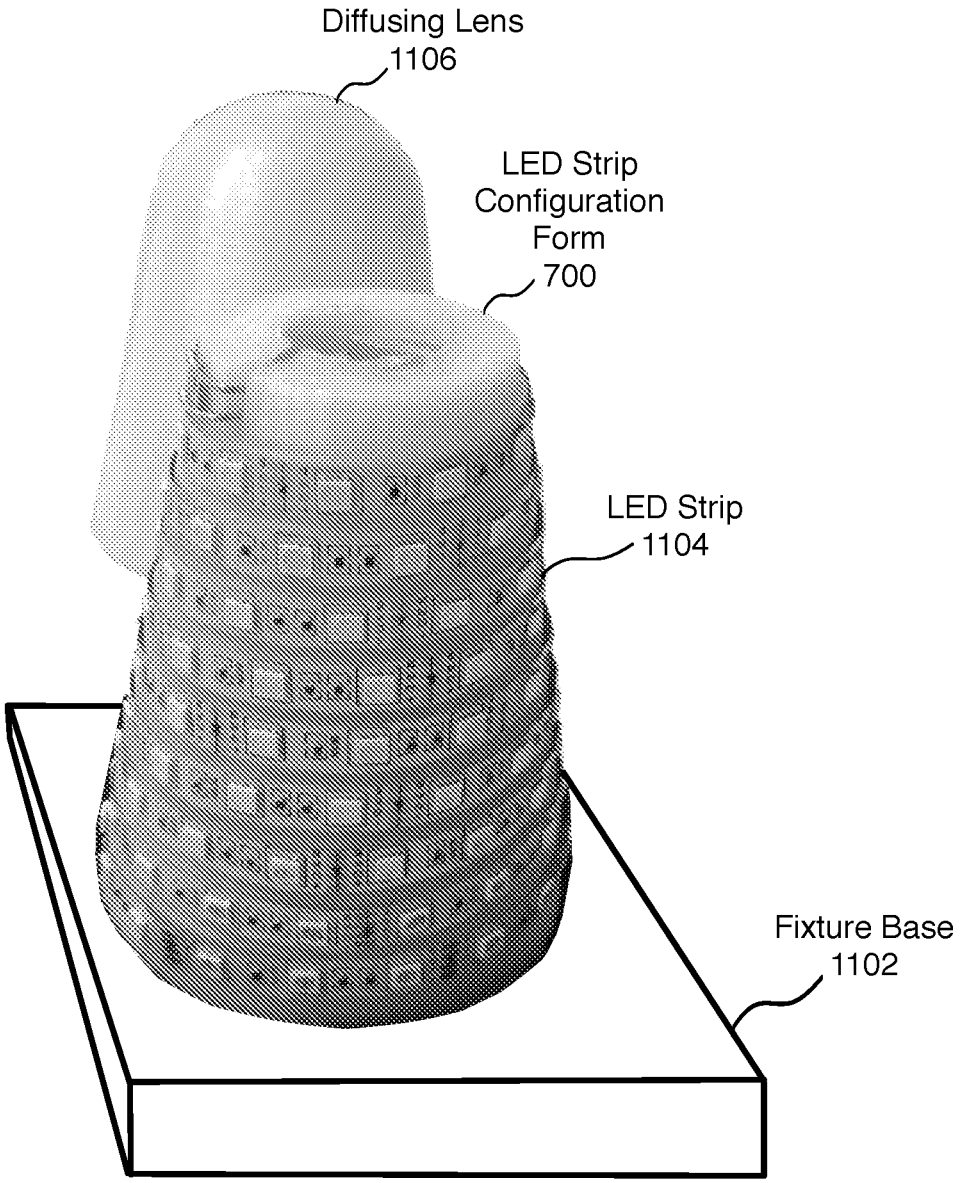
FIG. 11 illustrates a perspective view of the example LED strip configuration form of FIG. 7 mounted to a fixture base, according to some implementations.

FIG. 11 illustrates a perspective view of the example LED strip configuration form 700 of FIG. 7 mounted to a fixture base 1102, according to some implementations. Shown are completed table lamp assembly revealing LED strip configuration form 700 mounted on a fixture base 1102, with its accompanying LED strip 1104, which is wrapped around LED strip configuration form 700. Also shown is a diffusing lens 1106, which is removed from the table lamp assembly.

In various implementations, diffusing lens 1106 is configured to cover LED strip 1104 when the diffusing lens is mounted on fixture base 1102. The LED strip configuration form is configured to be covered by a diffusing lens when mounted on fixture base 1102. As such, the diffusing lens is configured to complement and conform to the predetermined shape of the LED strip configuration form 700.

The LED strip configuration form, complementary diffusing lens, and form base components of FIG. 7 may be directly produced by a 3D printer. As with the example of FIG. 1, similar thermoformed components of superior quality may be produced by using 3D printed parts as molding forms.

The table lamp depicted in FIG. 11 employs 2 meters of 12-volt RED/GREEN/BLUE LED strip, configured by winding on conically spiraled LED strip configuration form 700, and covered with complementary diffusing lens 1106. Fixture base 1102 houses various electronics (hidden from view), which include an LED controller module, a switch to turn power on and off, a pushbutton to trigger operations of the LED controller, and a connector to accept the output of a wall mounted LED power supply or a 12 volt battery pack.

Figure 12:
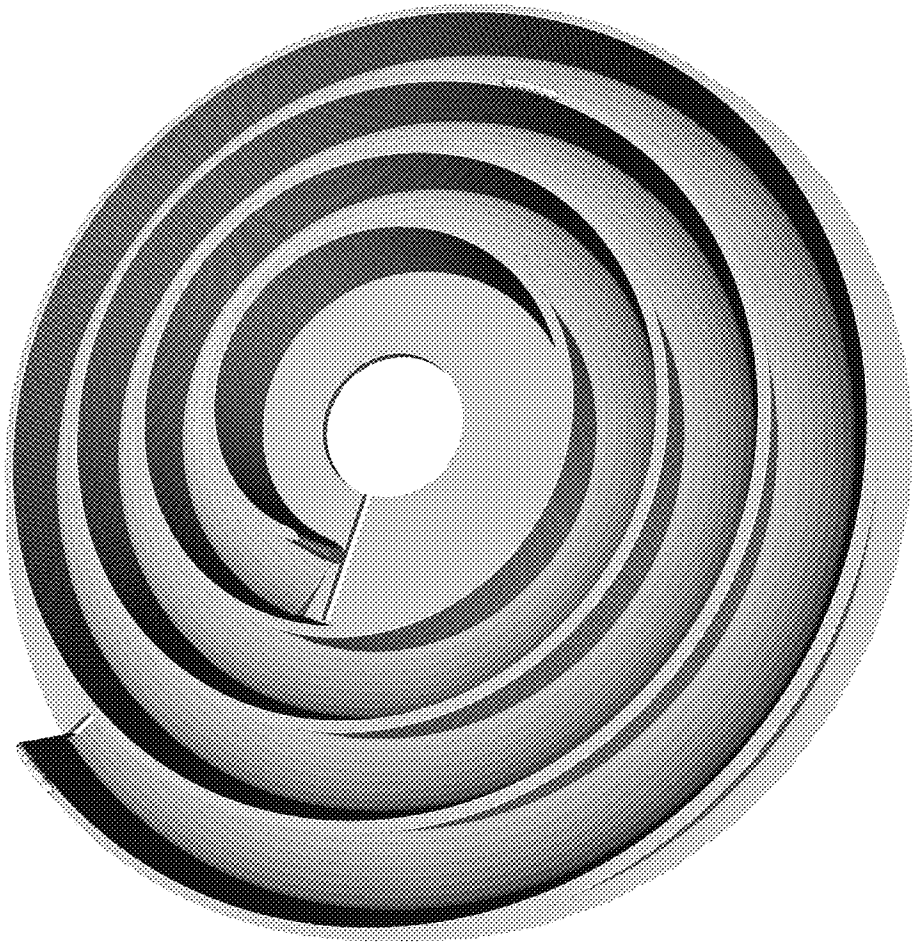
FIG. 12 illustrates a perspective view of an example LED strip configuration form in a ceiling or wall fixture configuration, according to some implementations.

FIG. 12 illustrates a perspective view of an example LED strip configuration form 1200 in a ceiling or wall fixture configuration, according to some implementations. In this particular implementation, the fixture configuration is a minimalist functional ceiling or wall fixture supported by a standard duplex electrical outlet, and employing an LED strip configuration form.

Figure 13:
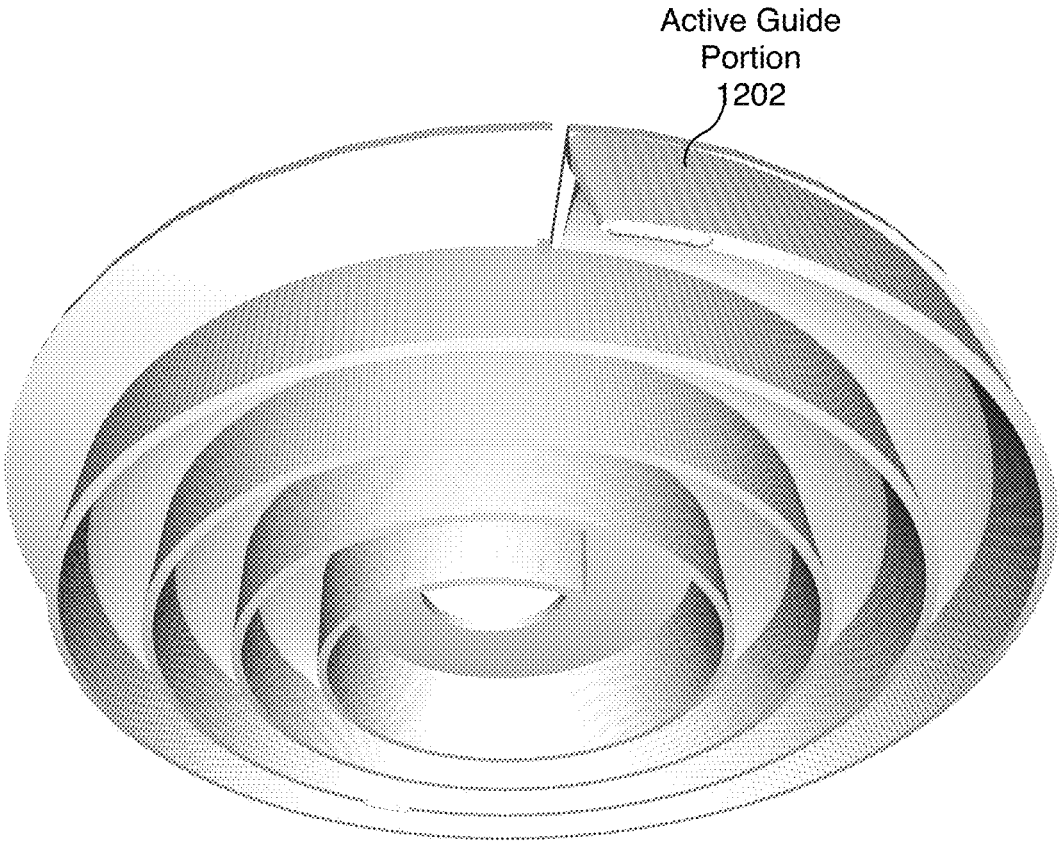
FIG. 13 illustrates another perspective view of the example LED strip configuration form of FIG. 12, according to some implementations.

FIG. 13 illustrates another perspective view of the example LED strip configuration form 1200 of FIG. 12, according to some implementations. In this particular implementation, LED strip configuration form 1200 is oriented to be mounted on the ceiling. Other orientations are possible and will depend on the particular implementation. For example, LED strip configuration form 1200 may be oriented to be mounted on a wall. The shape of the example in FIG. 13 has a low profile, being cylindrical in shape versus a conical. As shown, LED strip configuration form 1200 includes a constraint mechanism (e.g., spiral portion 1202).

Figure 14:
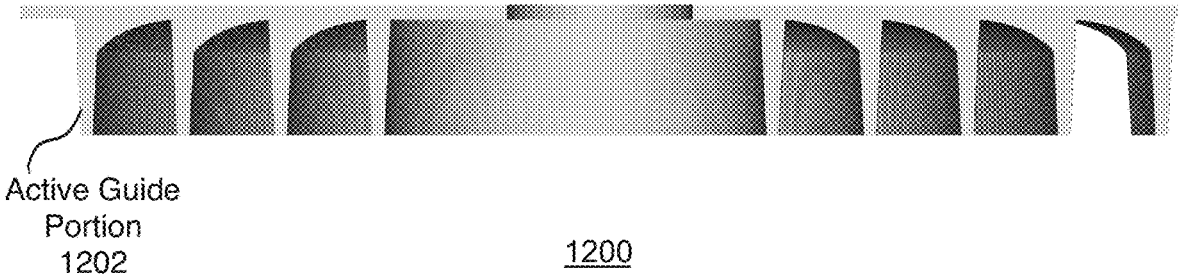
FIG. 14 illustrates a cross-sectional view of the example LED strip configuration form of FIG. 12, according to some implementations.

FIG. 14 illustrates a cross-sectional view of the example LED strip configuration form 1200 of FIG. 12, according to some implementations. Shown is spirally configured active guide portion 1202. In some implementations, the predetermined shape has the luminous body geometry shape of a flat disc (e.g., cylindrical), and where the predetermined shape also has a strip scale geometry that forms a spirally configured active guide track.

At the center is a flat ring feature (an opening) that facilitates mounting the form to the center stem of the fixture. The flat upper surface extends to the outer dimension of the form, with a maximum radius equal to the largest local radius of the spiraling LED strip-mounting surface. Moving outward from the center, we see a profile of the innermost spiral ring, followed by similar profiles progressing horizontally outward at 10 mm spacing. The outward face of the spiral is the intended mounting track for an LED strip.

Complete vertical compression produces a luminous body geometry of a flat disc. The overall luminous body geometry of conical shape is a good match for common legacy fixtures, and permits retrofits that improve luminance as well as efficiency. For specific fixtures, the luminous body geometry could be adjusted to resemble a hemisphere, or any arbitrary contour. This example illustrates the relative independence of strip scale and overall luminous body geometries within the LED strip configuration form.

Figure 15:
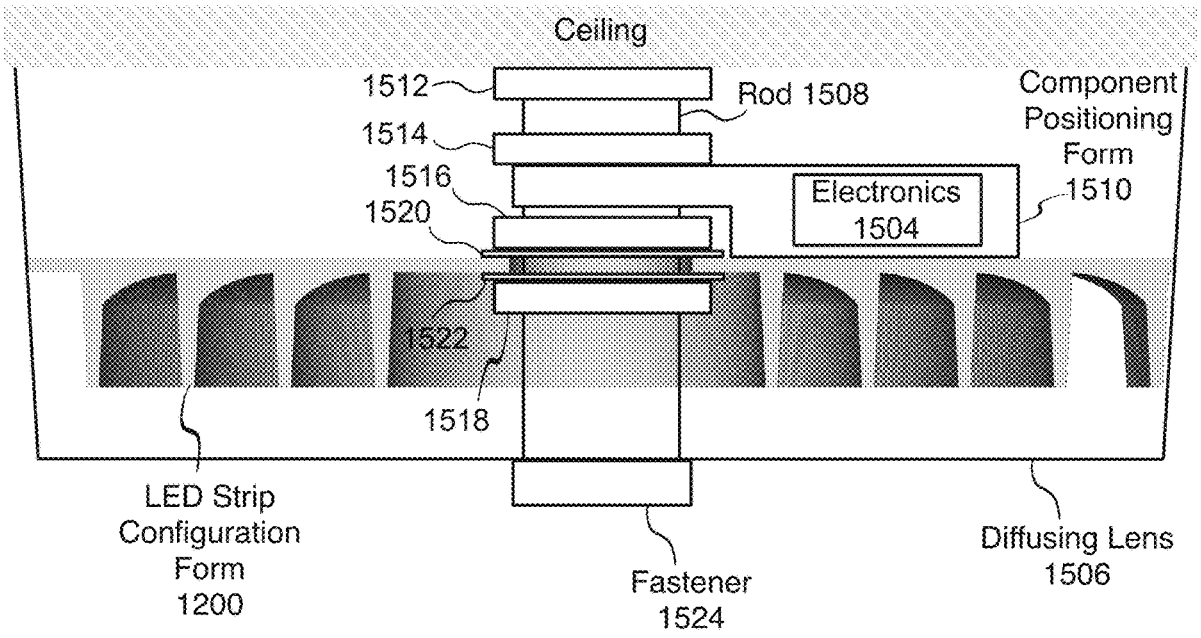
FIG. 15 illustrates an example fixture assembly that includes the example LED strip configuration form of FIG. 12, according to some implementations.

FIG. 15 illustrates an example fixture assembly 1500 that includes the example LED strip configuration form 1200 of FIG. 12, according to some implementations. Shown are LED strip configuration form 1200 and a diffusing lens 1506, which are attached to the fixture infrastructure.

In this particular implementation, fixture infrastructure includes a length of 6-32 threaded rod 1508 coupled with nuts and washers that anchor rod 1508 to a standard duplex outlet at one end, the diffusing lens at the other end, the component positioning form 1510 and the LED strip configuration form 1200 at intermediate positions. The duplex outlet, a standard item mounted per standard practice within the ceiling or wall, is not considered part of the fixture. The particular size relative to the LED strip configuration form may vary and will depend on the particular implementation. In various implementations, the fixture may include one or more component positioning form(s) 1510, and is configured to support one or more fixture components such as electronics 1504, LED strip configuration form 1200, and a diffusing lens 1506. In various implementations, electronics 1504 may include any necessary electronic components (not shown) including electronic circuitry such as for dimming control, a power supply, etc. In this particular implementation, component positioning form 1511 is anchored to rod 1508 at a position that places the form near or in contact with the top of the LED strip configuration form, thus constraining electronics to remain within their compartment. In this case, proximity of the component positioning form to the LED strip configuration form within the fixture serves as a constraint mechanism to enclose electronics securely within the intended compartment of the component configuration form. In an alternative implementation in which a power supply is the only necessary electronic component, a "wall mount" style power supply may be mounted by simply plugging it into the duplex outlet. Need for a component positioning form would thereby be obviated. In another alternative implementation, active features of the component positioning form could be added to the upper boundary of the LED strip configuration form to create a single hybrid form serving both functions.

In some implementations, the fixture infrastructure includes a threaded rod 1508 coupled to nuts 1512, 1514, 1516, and 1518, and washers 1520 and 1522, and to fastener 1524. These fixture infrastructure elements may also be referred to as fixture infrastructure components. In other implementations, the fixture infrastructure may not have all of the components shown and/or may have other elements including other types of elements instead of, or in addition to, those shown herein.

In various implementations, the upper portion of rod 1508 may connect to hardware in the ceiling (or a wall) and be secured to it with nut 1512 (optionally with a lock washer) shown at the top portion of rod 1508. The middle portion of rod 1508 passes through component positioning form 1510, LED strip configuration form 1200, and diffusing lens 1506. As indicated above, LED strip configuration form 1200 is secured by nuts 1516 and 1518, and washers 1520 and 1522 above and below its position along rod 1508. The lowest portion of rod 1508 screws into a nut or fastener 1524, which serves to secure the position of diffusing lens 1506. Torque on the outermost nut or fastener 1524 presses the outer rim of diffusing lens 1506 against the wall or ceiling, thus mechanically stabilizing the outermost portions of the fixture assembly.

Figure 16:
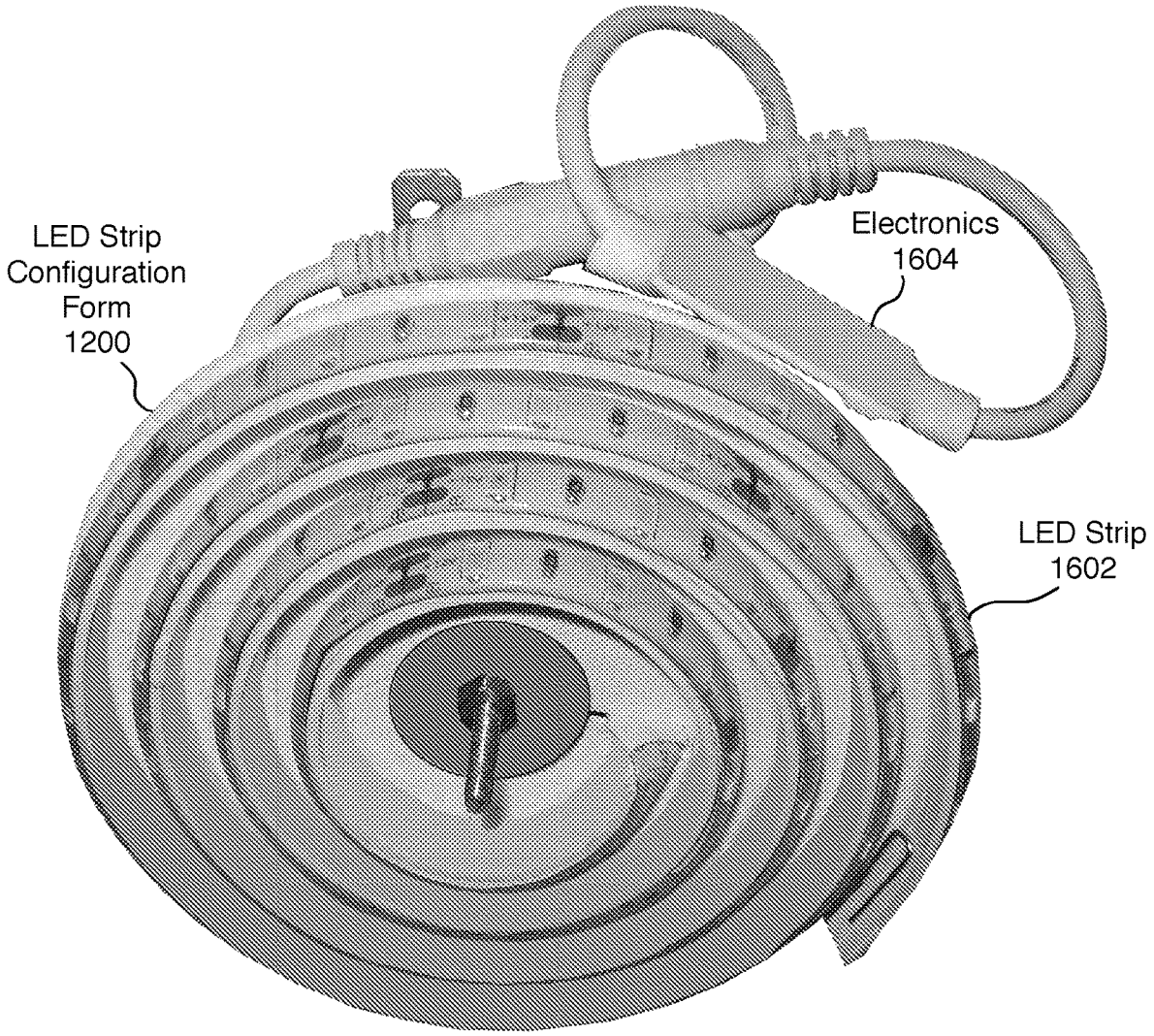
FIG. 16 illustrates a perspective view of the example LED strip configuration form of FIG. 12 mounted to a fixture infrastructure, according to some implementations.

FIG. 16 illustrates a perspective view of the example LED strip configuration form 1200 of FIG. 12 mounted to a fixture infrastructure, according to some implementations. Shown are a minimalist functional ceiling or wall fixture that employs an LED strip configuration form and complementary diffuser lens (diffuser lens removed for illustration) as its only non-standard components. It uses 1 meter of 12-volt LED strip lights, similar to those of the fixture of FIG. 6, producing 1116 lumens, approximately 75-watt incandescent equivalent. It uses a 12-volt, 1 amp wall mount power supply. Additional electronics 1506, a wireless LED controller, is small enough to be mounted by its own connecting wires so requires no component positioning form. The particular electronic specifications may vary, depending on the particular implementation.

The example assembly shown is built upon a standard duplex outlet. The power supply is mounted by plugging it into an outlet (hidden from view). A small indicator light on the power supply may indicate that it is receiving power from the outlet. A length of standard 6-32 threaded rod is inserted into the threaded hole of the duplex outlet normally used to attach a cover plate. The threaded rod is cut and adjusted so that a few threads protrude beyond the diffuser lens when its skirt is pressed against the surrounding surface. The threaded rod is secured in place with a 6-32 nut against the duplex outlet. A second 6-32 nut is positioned to back a washer that just clears the power supply.

In this example implementation, LED strip configuration form 1200 has a 1-meter length of a flat spirally configured active guide portion, upon which 1 meter of LED strip has been affixed. Another washer and 6-32 nut fix the LED strip assembly firmly in place between the two washers. In this example, strip scale geometry is a simple (fully compressed) spiral, while overall luminous body geometry is a flat disc. This particular fixture is built on an outlet that is not switched. To provide switching capability, a wireless LED controller is connected between the power supply and the LED strip assembly.

To complete the assembly, a diffuser lens may be mounted on a threaded rod, and secured against the ceiling or wall surface with a 6-32 nut, similar to rod 1508 of FIG. 15, for example. A finial nut may be used, optionally with a decorative washer. In some implementations, a standard nut may be covered with a decorative cap.

LED strip configuration form 1200 and diffusing lens 1506 are directly produced by a 3D printer. When printed in a suitable material, they may be used as molds for superior thermoformed copies of these two non-standard components.

In operation, light from LEDs affixed to the outer-most spiral radiates unimpeded. Some light from LEDs from inner spirals will pass unimpeded, some will strike the backing surface of the next outward-most spiral, and some will strike the upper surface. Careful design can optimize lighting efficiency by using high reflectivity material, and contouring surfaces for minimum reflections before exit. In addition, surface contours may be designed to reflect light in conformance with a variety of emission patterns as may be deemed desirable. For example, if a very directional emission pattern (e.g., a spot light) is desired, the spiral track may be given a large vertical dimension, and the LED strip mounted as far as possible into the semi-enclosed space thus formed. Light would be thereby be channeled into a primarily vertical exit path. The outer-most spiral would be used only as a reflector, not as a mounting surface for outward facing LEDs. In addition, radiation characteristics of specific LEDs intended to be used may be taken into account.

In this example, the strip scale geometry contour of the upper surface is shaped to facilitate reflection versus entrapment of light. Refer also to FIG. 14. To achieve vertical reflection, the curved surface should be horizontal directly above the LED emitter, and sloping downward at a 45-degree angle directly in front of the LED emitter. The top contour depicted would meet the center of the next outward-most LED mounting surface at 45-degrees, but is interrupted by the more rapidly rising inward-facing surface of the spiral.

For efficient manufacture, it is proposed that LED strip configuration forms be created with a molding process such as thermoforming. Forms so produced will likely be made of thin sheet material, heated to a pliable temperature and conformed to the active surface of a mold with vacuum. With minor adjustments, the 3D printed form of this example, as illustrated in FIGS. 12-16, may be used as a mold for such a process. The product would not have a flat top over its entire diameter. Instead, its upper surface would mirror its lower surface with a depression opposite every prominence and vice versa. The thin flat portions at the center and outer extreme would remain similarly disposed. If the LED strip configuration form is produced by thermoforming of clear material, the LED strip may be inserted in the spiral trough created by the thermoforming process. In some implementations, features could be added to the upper opening of the spiral trough to snap into place above the LED strip, thus constraining its assembly within the trough. Such construction would facilitate assembly of the LED strip to the LED strip configuration form, and obviate need for other constraint mechanisms.

For optimal LED strip conformance to the LED strip configuration form, a vertical mounting surface would be ideal. The designs of FIG. 3, FIG. 7 and FIG. 12 deviate from that ideal by a 3-degree draft angle to facilitate removal of thermoformed copies after molding.

In various implementations, the LED strip configuration form assemblies described herein may include an adapter mechanism configured to couple the LED strip configuration form assembly to a legacy fixture and to convert legacy lighting to LED lighting. A wall mount power supply is plugged into an outlet adapter installed in the legacy fixture's light bulb socket. Thus, no component positioning form is necessary. The LED strip assembly is mounted to the center stem of the fixture with washers and nuts of appropriate sizing.

In some implementations, an LED strip configuration form assembly may be optionally coupled with a suitable power supply and socket-to-female-plug adapter, and might be considered an adapter mechanism to retrofit many legacy incandescent fixtures to LED illumination.

This example illustrates the versatility of LED strips mated with LED strip configuration forms to function in a variety of applications. In this regard, they are similar to traditional light bulbs. Multiple aesthetically varied fixture designs may be fashioned around one or more of a single LED strip configuration form geometry considered standard by its manufacturer.

Figure 17:
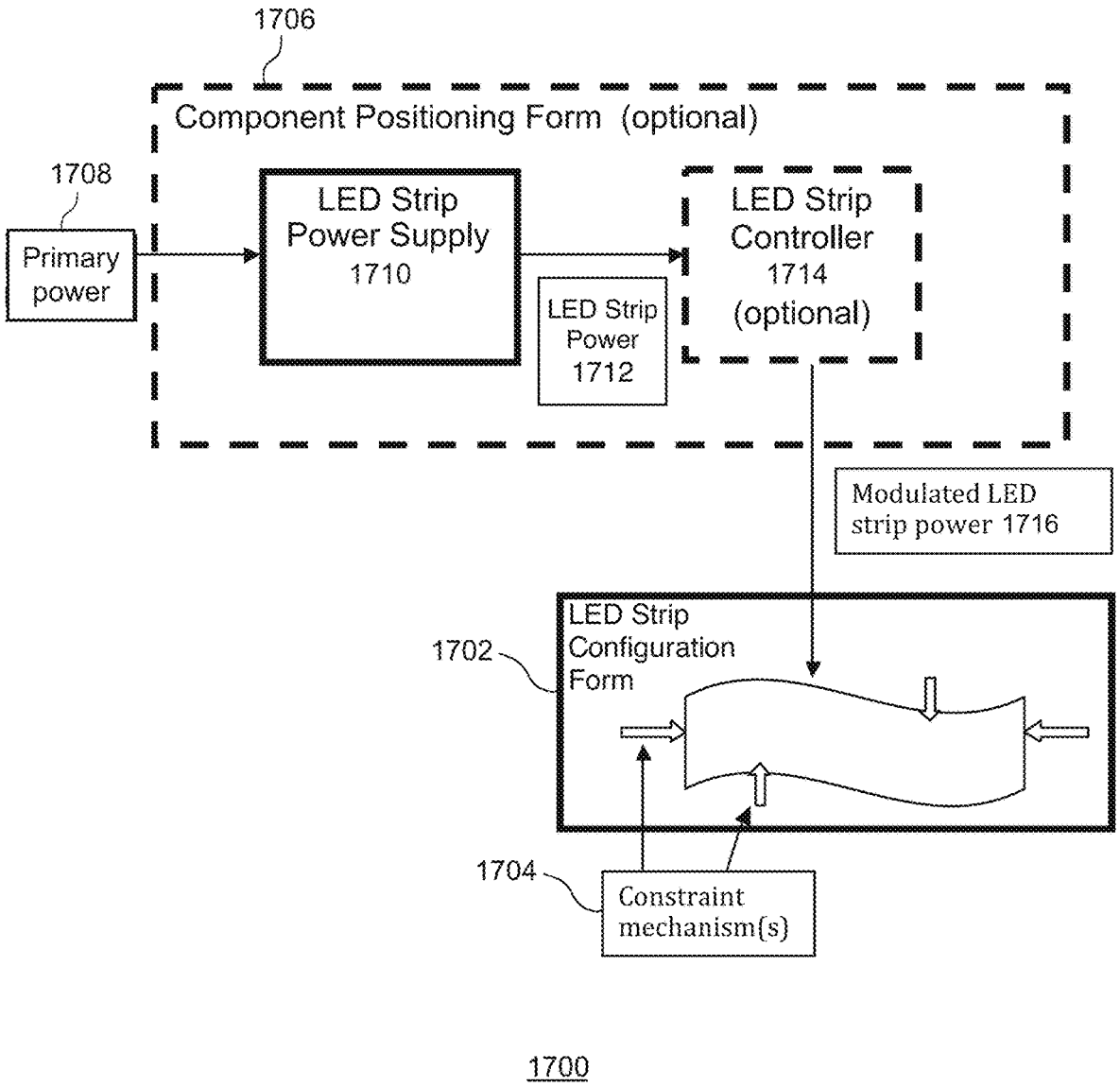
FIG. 17 illustrates an example block diagram of components of a lighting fixture that employs an LED strip configuration form, according to some implementations.

FIG. 17 illustrates an example block diagram of components of a lighting fixture 1700 that employs an LED strip configuration form 1702, according to some implementations. Shown is LED strip configuration form 1702 including constraint mechanisms 1704. Also shown are an optional component positioning form 1706 and a primary power unit 1708. Component positioning form 1706 includes positioning features for an LED strip power supply 1710 that provides LED strip power 1712 to an optional LED strip controller 1714, which provides modulated LED strip power 1716 to an LED strip (not shown) coupled to LED strip configuration form 1702.

In this particular example implementation, primary power unit 1708 is 115 VAC 60-Hz in the U.S., and is controlled by a power switch that is applied to the fixture. An LED power supply within the fixture converts primary power to direct current, at a voltage compatible with the LED strip(s) to be used in the fixture, typically 5-24 VDC. Optional LED controller 1714 may be used to modulate the power from the power supply so as to effect dimming of a single color LED strip, or color and brightness control of a multi-color LED strip. In various implementations, lighting fixture 1700 may include various other components (not shown) such as a fixture infrastructure box and/or connectors, diffusing lens, and a bezel or form base.

Economical physical placement of these components may be achieved by employing a component positioning form, further described herein, and represented in the figure by a dashed enclosure around the LED Power supply and controller. LED strip power, optionally modulated by a controller, is applied to an LED strip, which is the light emitting element of the fixture. The LED strip is affixed to an LED strip configuration form. The LED strip configuration form causes the LED strip to comply with a desired strip scale geometry, eliminating the natural flexibility of the LED strip, and thereby creating the desired overall luminous body geometry. One or more additional constraint mechanisms, represented by multiple block arrows, may be employed to assure that the LED strip remains reliably conformed to the target geometry of the LED strip configuration form during the service life and normal operation of the LED fixture. Among various constraint mechanisms that may be employed, the strip scale geometry of the LED strip configuration form is a prominent contributor. In some cases, strip scale geometry may constitute the only necessary constraint mechanism. Within the LED strip configuration form, LED strip constraint mechanism(s), and component positioning form(s), appropriate transparent, translucent, or reflective materials and geometries are employed to effect the desired light emission pattern of the fixture.

The following describes example LED strip configuration form geometrical variants that may be applied to the various implementations described herein. It is useful to describe LED strip configuration form shapes in terms of compound geometries. Strip scale geometry is constructed for compatibility with practical flexibility modes of LED strips, as well as to usefully direct the emitted light of each individual LED. Terms such as track, trough, and/or reflector are useful descriptors of strip scale geometry. Luminous body geometry of appropriate scale may be formed by continuous extension of strip scale geometry in a manner that facilitates using LED strip(s) as a single, contiguous segment(s) with no cuts. Multiple tracks of strip scale geometry may be employed to accommodate multiple separate LED strip segments within the same luminous body. For example, the single spiral track could instead include two interleaved spiral tracks. In that configuration, one track could accommodate a white LED strip, while the other accommodates a red/green/blue color LED strip. The combined illumination from these two segments could produce any combination of high quality white and/or high saturation color of any hue within the overall flat disc luminous body geometry. For complex luminous body geometries, multiple LED strip configuration form segments may be employed. Some luminous body geometries, such as multi-pointed stars, may lend themselves to spatial animation of the illumination pattern. In such cases, strip scale geometry may be used to accommodate separate LED strip segments for each portion of the luminous body geometry for which luminance is separately controlled.

Examples of luminous body geometries illustrated are of flat disc or truncated conical geometry. Many other forms are possible. Almost any two dimensional form, such as rectangular, oval, star shaped, regular or irregular polygons, or a bow tie shape, letters for illuminated signs, to name a few, are feasible and readily manufactured using thermoforming processes. Numerous three dimensional luminous body geometries are also feasible, such as aforementioned two-dimensional geometries coupled with a depth profile, such that they are readily manufactured with thermoforming techniques. Other three dimensional forms, such as spheres, cubes, cylinders, standard incandescent bulb shape and the like are theoretically possible, but may require more sophisticated manufacturing techniques than thermoforming. In some implementations, one or more single LED strip segments may be configured into a functional geometry with a useful light emission pattern. This may involve a "progressively smaller repeating" shape, and may also be a single decorative shape, such as a bow tie. LED strip configuration forms of primarily conical geometry, as depicted in FIG. 1, may gain aesthetic benefit by combining a conical luminous body geometry with flat rings for the innermost and outermost full turns of the strip scale geometry. This variation permits the large and small ends of the cone to appear as ring shaped, as opposed to spirals with abrupt end points.

LED strip configuration forms may be designed with any strip scale geometry to which a flexible LED strip may be conformed. A primary function of the LED strip configuration form, including the inherent constraint mechanism of its strip scale geometry, along with any additional associated constraint mechanism(s), is to remove the flexibility of the flexible LED strip, thereby adapting it for a particular application. Other functions may include reflecting or transmitting light so as to form desired emission patterns, facilitating mounting and positioning of the configured LED strip, and facilitating mounting and positioning of a component configuration form, and/or of ancillary components within an LED fixture.

The following describes example LED strip configuration form constraint mechanism variants that may be applied to the various implementations described herein. When an LED strip is formed into a luminous body geometry by means of an LED strip configuration form, the strip scale geometry of the LED strip configuration form is an inherent constraint mechanism that causes the flexible led strip to conform to a desired overall luminous body shape. One or more additional, co-active constraint mechanisms may be necessary to assure that the LED strip remains in close conformance with the form's strip scale geometry, and thereby with its luminous body geometry, and does not become dislodged during normal use or handling. A variety of co-active constraint mechanisms are possible which, either singly or in combination, may be suitable for a given application.

For a use case in which strip scale geometry uses a track/trough form, and intended for use in an upward-facing orientation, the simplest imaginable co-active constraint mechanism is gravity. In this case, the LED strip would be simply formed and dropped into the spiral trough geometry. If undisturbed, it would remain approximately in place merely by the force of gravity holding it to the bottom of the trough. The gravity approach, however, has several practical drawbacks. They include the LED strip's tendency to spontaneously straighten due to its own natural stiffness, forcing it to the outer track formed by the trough's walls. This could be an advantage in the case of an LED strip installed with inward-facing emitters. In contrast, outward-facing emitters would be forced close to the trough wall, diminishing effective light reflection and ultimate emission. Another drawback of gravity constraint for this example is extreme sensitivity to handling. Merely moving the assembly without maintaining vertical orientation, or with substantial acceleration, could cause spontaneous disassembly. As a practical matter, luminaires are seldom deployed to illuminate a ceiling.

In some implementations, the active guide portion of the LED configuration strip includes a mounting surface that is configured to bond with an adhesive material for mounting the at least one LED strip. In some implementations, for the use case depicted in FIG. 16, for example, the co-active constraint mechanism is an adhesive attachment of the LED strip to the track wall. LED strips are commonly manufactured with adhesive backing. In theory, such backing provides a convenient and readily available mounting method and constraint mechanism. In practice, the assembly of FIG. 16 may include some modification when using a LED strip's manufacturer supplied adhesive backing as the exclusive constraint mechanism. For example, a supplied adhesive may prove insufficiently robust to prevent the LED strip's natural stiffness from pulling the outer end of the strip away from its track. In some embodiments, a paper clip or other fastening device may be employed as a supplementary co-active constraint mechanism to overcome this potential shortfall. A drop of hot glue adhesive may also be applied to more robustly affix the inner end of the LED strip in FIG. 16. Similarly, for the use case depicted in FIG. 11, paper clips were used at each end of the LED strip to supplement adhesive backing. In the use case depicted in FIG. 6, the force of gravity encourages the LED strip to detach and fall or sag from the track to which it is affixed with adhesive backing. In that case, numerous spot applications of hot glue adhesive proved necessary to make the adhesive-based co-active constraint mechanism sufficiently robust.

Despite its pitfalls, exclusive use of an adhesive based co-active constraint mechanism may be practical for some applications. For best results, the intended mounting surface of the LED strip configuration form should be of a smooth texture for manufacturer supplied LED strip adhesive backing, and material chosen for compatibility with the intended adhesive.

Numerous alternative co-active constraint mechanisms may supplement or replace adhesive constraint. Some may be built into the LED strip configuration form itself as features of strip scale geometry. Others, such as clips and staples, can be added during assembly. One possibility is to equip the track feature of the strip scale geometry of the LED strip configuration form with constraining rails. Spacing and geometry of the rails would be formed such that an LED strip of the desired width would snap in between them, and thus be constrained in a robust fashion. Such rails could either be contiguous, or consist of small, discrete fingers distributed periodically along the edges of the LED strip track. Constraining rails or fingers may be practical with some manufacturing techniques. However, they constitute a strip scale geometry largely incompatible with formation by thermoforming or metal stamping techniques.

A practical, economical and robust approach to constraint may be realized by thermoforming the LED strip configuration form using clear or translucent material with a strip scale geometry designed to substantially contain the LED strip. Such a configuration may require no additional constraints, or may be designed to snap together with a complementary containment cover thermoformed of opaque, reflective material. Using the strip scale geometry of FIG. 16 as an example, the LED strip configuration form may be thermoformed of clear sheet material, using the depicted form as a mold. Instead of adhering the LED strip to the outside track wall, as depicted in FIG. 16, the LED strip may instead be inserted into the molded depression behind the track wall. A reflective thermoformed-backing disc could then be snapped together with mating features of the LED strip configuration form to robustly constrain the LED strip with near complete enclosure. The snap-on constrainer/reflector may be of a geometry as simple as a flat disc with a hole in the center to accommodate mounting of the LED strip assembly, or could feature strip scale geometry contoured surfaces similar to the profile depicted in FIG. 15 to more effectively reflect emitted light. As described here, the constrainer/reflector is compatible with manufacture by either thermoforming or sheet metal stamping.

In the example given above, the LED strip may be inserted with LED emitters facing either inward or outward, depending on the desired emission pattern. The constrainer/reflector may also be crafted to support the desired emission pattern. To increase luminous density, two LED strip segments, or a single segment doubled over, could be inserted back-to-back such that one set of LED emitters faces outward and the other faces inward. Such an arrangement may be desirable for high intensity lighting within a compact space. However, the arrangement may also increase heat dissipation requirements to a point requiring explicit thermal management. For such an arrangement, a constrainer/reflector formed of stamped metal, or other material of high thermal conductivity, can provide a distinct additional advantage. The constrainer/reflector may be easily provided with heat radiating fins to more efficiently transfer dissipated heat to surrounding ambient air. Also, by mounting to a thermally conductive center stem of a fixture, it can facilitate heat dissipation via that path.

In many use cases, concerns about efficient reflectivity, and attendant strip scale geometry details, may be rendered moot by employing side emitting LED strips to achieve a desired luminous emission pattern that does not rely on reflections.

The following describes example strip scale geometry special cases that may be applied to the various implementations described herein. As herein discussed, strip scale geometry is an inherent constraint mechanism of every LED strip configuration form. For most overall luminous body geometries, features of the strip scale geometry constraint mechanism are readily identifiable with both visual and tactile indication of the intended LED strip placement due to physically demarcated dimensions based on dimensions of the LED strip. In certain special cases, strip scale geometry may naturally blend smoothly with overall luminous body geometry to obscure tactile indication. An overall luminous body of straight cylindrical geometry is an example of such a special case. For such special cases, portions of the luminous body geometry that coincide with the intended position of strip scale geometry may be visually indicated by coloration, surface etching, or similar means.

The following describes example component positioning form variants that may be applied to the various implementations described herein. Within a fixture that employs an LED strip configuration form, a component positioning form affords an economical and convenient approach to mounting the necessary LED strip power supply, an optional LED strip controller, and potentially other components deemed desirable within the fixture. For example, a common structure for a ceiling fixture employs a threaded center stem, which in turn serves to support the fixture's outer diffuser or lens. In traditional designs, other components, such as light bulb sockets, are mounted with an array of custom brackets and hardware. A component positioning form can easily be devised to mount on the center stem of the fixture, obviating any need for other custom brackets and hardware. It may be formed of reflective material, and shaped to enhance the overall emission pattern of the fixture. Appropriate constraint mechanisms associated with component positioning forms are similar to those associated with the LED strip configuration forms. Depending on the application, they may include gravity, adhesives, compartment covers, clips and the like. In addition, placement of a component positioning form in proximity to another fixture element may effectively enclose the component(s) to be positioned within a compartment, thereby obviating the need for a compartment cover. If desired, a separate smooth thermoformed reflector may be employed between the component positioning form and the LED strip assembly. LED strip configuration forms and associated constraint mechanisms can also be designed to mount on the center stem, employing minimum standard hardware and obviating any need for separate sockets. Thus, with traditional mounting of the outer lens or diffuser, all of the fixture's internal components may be mounted to the center stem with reduced complexity and improved economy.

The following describes example optical property variants that may be applied to the various implementations described herein. Optical properties of fixture components greatly impact both lighting performance and aesthetics. Previous discussion has highlighted functional aspects of reflective and transmissive materials to achieve a desirable light emission pattern. It should be recognized that the nature of discrete LED emitters presents aesthetic possibilities and challenges that will affect design choices.

In many cases, it will be desirable to diffuse the overall light emission pattern for a relatively smooth appearance. However, discrete LED emitters also present the opportunity to emphasize a jewel-like illumination pattern. This may be fostered by positioning LEDs physically close to the outer lens or diffuser of the fixture. In examples given, LEDs are oriented in an outward-facing direction, not covered by translucent material. Their positions are therefore highlighted in all examples shown. If LED strips were reoriented to face inward and/or contained within translucent material, their discrete positioning would be less apparent when viewed externally.

The conical overall luminous body geometry of FIG. 1 could be extended vertically, and surrounded with a "rain glass" like lens to produce a sparkling chandelier effect.

Although the description has been described with respect to particular embodiments thereof, these particular embodiments are merely illustrative, and not restrictive. Concepts illustrated in the examples may be applied to other examples and implementations.

It will also be appreciated that one or more of the elements depicted in the drawings/figures can also be implemented in a more separated or integrated manner, or even removed or rendered as inoperable in certain cases, as is useful in accordance with a particular application.

Figure 18:
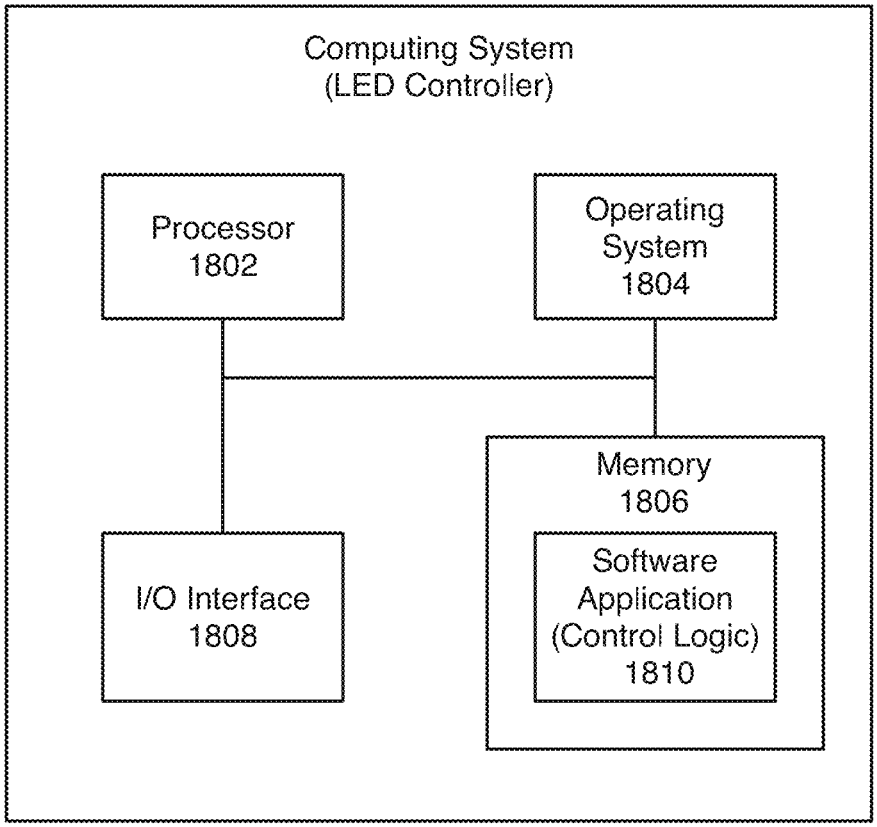
FIG. 18 illustrates a block diagram of an example computing system, which may be used for some implementations described herein.

FIG. 18 illustrates a block diagram of an example computing system 1800, which may be used for some implementations described herein. For example, computing system 1800 may be used to implement LED strip controller 1714 FIG. 17. In some implementations, computing system 1800 may include a processor 1802, an operating system 1804, a memory 1806, and an input/output (I/O) interface 1808. In various implementations, processor 1802 may be used to implement various functions and features described herein, as well as to perform the method implementations described herein. While processor 1802 is described as performing implementations described herein, any suitable component or combination of components of computing system 1800 or any suitable processor or processors associated with computing system 1800 or any suitable system may perform the steps described. Implementations described herein may be carried out on a user device, on a server, or a combination of both.

Computing system 1800 also includes a software application 1810, which may be stored on memory 1806 or on any other suitable storage location or computer-readable medium. Software application 1810 provides instructions that enable processor 1802 to perform the implementations described herein and other functions. Software application may also include an engine such as a network engine for performing various functions associated with one or more networks and network communications. The components of computing system 1800 may be implemented by one or more processors or any combination of hardware devices, as well as any combination of hardware, software, firmware, etc.

For ease of illustration, FIG. 18 shows one block for each of processor 1802, operating system 1804, memory 1806, I/O interface 1808, and software application 1810. These blocks 1802, 1804, 1806, 1808, and 1810 may represent multiple processors, operating systems, memories, I/O interfaces, and software applications. In various implementations, computing system 1800 may not have all of the components shown and/or may have other elements including other types of components instead of, or in addition to, those shown herein.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

What is claimed is:

1. An apparatus for providing light emitting diode (LED) lighting, the apparatus comprising:

a physical form having a predetermined shape, wherein the form is configured to support at least one LED strip thereto, and wherein the predetermined shape causes the at least one LED strip to be so configured as to emit light in a predetermined emission pattern when the at least one LED strip is coupled to the physical form; and at least one constraint mechanism, wherein the at least one constraint mechanism, in whole or in part, constrains the at least one LED strip to remain configured to its predetermined shape, and wherein the at least one constraint mechanism includes a strip scale geometry, wherein the strip scale geometry is a geometry that is based on dimensions of the at least one LED strip, and wherein the strip scale geometry forms an active guide track that interacts directly with the at least one LED strip.

2. The apparatus of claim 1, wherein the predetermined shape has a luminous body geometry that is conical in shape, and wherein the at least one constraint mechanism configures the at least one LED strip into a conical spiral.

3. The apparatus of claim 1, wherein the predetermined shape has the luminous body geometry shape of a flat disc, and wherein the predetermined shape also has a strip scale geometry, and wherein the strip scale geometry is a geometry that forms a spirally configured active guide track that interacts directly with the at least one LED strip.

4. The apparatus of claim 1, wherein the physical form is made of plastic.

5. The apparatus of claim 1, wherein the physical form is made of metal.

6. The apparatus of claim 1, further comprising a reflective material coupled to the form, wherein the reflective material conforms to the predetermined shape and alters the predetermined light emission pattern.

7. The apparatus of claim 1, further comprising an adapter mechanism configured to couple the apparatus to a legacy fixture and to convert legacy lighting to LED lighting.

8. The apparatus of claim 1, wherein the physical form comprises removable portions that when removed alter a size of the physical form for target fixtures.

9. The apparatus of claim 1, wherein the physical form incorporates a mounting surface that is configured to bond with an adhesive material for mounting the at least one LED strip.

10. The apparatus of claim 1, wherein the physical form incorporates a mounting surface having marking features.

11. The apparatus of claim 1, further comprising a diffusing lens configured to cover the at least one LED strip when the diffusing lens is appropriately mounted.

12. The apparatus of claim 1, further comprising a diffusing lens configured to conform to and complement the predetermined shape of the physical form.

13. The apparatus of claim 1, further comprising geometrical features that facilitate positioning and constraint of components in addition to the at least one LED strip that contribute to overall function of a complete lighting fixture.

14. An apparatus for positioning ancillary components, the apparatus comprising:

a physical form that has a predetermined shape, wherein the form is configured to support at least one fixture component thereto, and wherein the predetermined shape causes the at least one fixture component to be so positioned as to contribute to overall function of a complete lighting fixture when coupled to other components of the at least one fixture component; and at least one constraint mechanism, wherein the at least one constraint mechanism, in whole or in part, constrains the at least one fixture component to remain so positioned, and wherein the at least one constraint mechanism includes a component scale geometry, wherein the component scale geometry is a geometry that is based on dimensions of the at least one fixture component, and wherein the component scale geometry forms a wholly or partially enclosed volume that interacts directly with the at least one fixture component to constrain its position.

15. The apparatus of claim 14, wherein the predetermined shape has a luminous body geometry that is conical in shape.

16. The apparatus of claim 14, wherein the predetermined shape has the luminous body geometry shape of a flat disc, and wherein the predetermined shape also has a strip scale geometry, and wherein the strip scale geometry is a geometry that forms a spirally configured active guide track that interacts directly with the at least one LED strip.

17. A system comprising:

a physical form having a predetermined shape, wherein the form is configured to support at least one light emitting diode (LED) strip thereto, and wherein the predetermined shape causes the at least one LED strip to be so configured as to emit light in a predetermined emission pattern when the at least one LED strip is coupled to the physical form;

at least one constraint mechanism, wherein the at least one constraint mechanism, in whole or in part, constrains the at least one LED strip to remain configured to its predetermined shape, and wherein the at least one constraint mechanism includes a strip scale geometry, wherein the strip scale geometry is a geometry that is based on dimensions of the at least one LED strip, and wherein the strip scale geometry forms an active guide track that interacts directly with the at least one LED strip; and one or more fixture infrastructure components configured to secure the physical form, wherein the physical form is configured to support at least one fixture component thereto.

18. The system of claim 17, wherein the predetermined shape of the physical form causes the at least one fixture component to be so positioned as to contribute to overall function of a complete lighting fixture when the at least one fixture component is coupled to the one or more fixture infrastructure components.

19. The system of claim 17, wherein the predetermined shape has a luminous body geometry that is conical in shape.

20. The system of claim 17, wherein the predetermined shape has the luminous body geometry shape of a flat disc, and wherein the predetermined shape also has a strip scale geometry that forms a spirally configured active guide track.

* * * * *